US008944105B2

(12) United States Patent
Rodenbeck et al.

(10) Patent No.: US 8,944,105 B2
(45) Date of Patent: Feb. 3, 2015

(54) CAPACITIVE SENSING APPARATUS AND METHOD FOR FAUCETS

(75) Inventors: Robert W. Rodenbeck, Indianapolis, IN (US); David M. Burke, Taylor, MI (US); Timothy J. Ensor, Cambridge (GB); Lindsey Hall, Cary, NC (US); Paul D. Koottungal, Leander, TX (US)

(73) Assignee: Masco Corporation of Indiana, Indianapolis, IN (US)

( * ) Notice: Subject to any disclaimer, the term of this patent is extended or adjusted under 35 U.S.C. 154(b) by 470 days.

(21) Appl. No.: 12/525,324

(22) PCT Filed: Jan. 31, 2008

(86) PCT No.: PCT/US2008/001288

§ 371 (c)(1),
(2), (4) Date: Nov. 11, 2009

(87) PCT Pub. No.: WO2008/094651

PCT Pub. Date: Aug. 7, 2008

(65) Prior Publication Data

US 2010/0108165 A1 May 6, 2010

Related U.S. Application Data

(60) Provisional application No. 60/898,524, filed on Jan. 31, 2007, provisional application No. 60/898,525, filed on Jan. 31, 2007.

(51) Int. Cl.
*F16K 21/00* (2006.01)
*E03C 1/05* (2006.01)

(52) U.S. Cl.
CPC ..... *E03C 1/057* (2013.01)
USPC ..... 137/801; 251/129.04; 4/623

(58) Field of Classification Search
USPC ..... 251/129.03, 129.04, 129.05, 129.06; 4/623; 137/801
See application file for complete search history.

(56) References Cited

U.S. PATENT DOCUMENTS

| | | | |
|---|---|---|---|
| 2,991,481 | A | 7/1961 | Book |
| 3,081,594 | A | 3/1963 | Atkins et al. |
| 3,151,340 | A | 10/1964 | Teshima |
| 3,254,313 | A | 5/1966 | Atkins et al. |
| 3,314,081 | A | 4/1967 | Atkins et al. |

(Continued)

FOREIGN PATENT DOCUMENTS

| | | |
|---|---|---|
| CA | 2492226 A1 | 7/2005 |
| DE | 3339849 | 5/1985 |

(Continued)

OTHER PUBLICATIONS

Camacho et al., Freescale Semiconductor, "Touch Pad System Using MC34940/MC33794 E-Field Sensors," Feb. 2006, 52 pgs.

(Continued)

*Primary Examiner* — Matthew W Jellett
(74) *Attorney, Agent, or Firm* — Faegre Baker Daniels LLP

(57) ABSTRACT

A fluid delivery apparatus includes a spout (12) located adjacent a sink basin (16). A fluid supply conduit (14) is supported by the spout (12). Capacitive sensors (29) and (41) are provided on the spout (12) and sink basin (16), respectively. A controller (26) is coupled to the capacitive sensors (29, 41) to control the amount of fluid supplied to the fluid supply conduit (14) based on outputs from the capacitive sensors (29, 41).

38 Claims, 19 Drawing Sheets

(56) References Cited

U.S. PATENT DOCUMENTS 3,333,160 A 7/1967 Gorski
3,406,941 A 10/1968 Ichimori et al.
3,588,038 A 6/1971 Tanaka
3,651,989 A 3/1972 Westrich
3,685,541 A 8/1972 Braucksick et al.
3,705,574 A 12/1972 Duncan
3,765,455 A 10/1973 Countryman
3,799,171 A 3/1974 Patel
3,987,819 A 10/1976 Scheuermann
4,185,336 A 1/1980 Young
4,201,518 A 5/1980 Stevenson
4,290,052 A 9/1981 Eichelberger et al.
4,295,132 A 10/1981 Burney et al.
4,331,292 A 5/1982 Zimmer
4,337,388 A 6/1982 July
4,359,186 A 11/1982 Kiendl
4,406,313 A 9/1983 Bennett et al.
4,407,444 A 10/1983 Knebel et al.
4,409,694 A 10/1983 Barrett et al.
4,410,791 A 10/1983 Eastep
4,420,811 A 12/1983 Tarnay et al.
4,421,269 A 12/1983 Ts'ao
4,424,767 A 1/1984 Wicke et al.
4,429,422 A 2/1984 Wareham
4,436,983 A 3/1984 Solobay
4,439,669 A 3/1984 Ryffel
4,450,829 A 5/1984 Morita et al.
4,459,465 A 7/1984 Knight
4,503,575 A 3/1985 Knoop et al.
4,537,348 A 8/1985 Gossi
4,541,562 A 9/1985 Zukausky
4,554,688 A 11/1985 Puccerella
4,563,780 A 1/1986 Pollack
4,567,350 A 1/1986 Todd, Jr.
4,581,707 A 4/1986 Millar
4,584,463 A 4/1986 Klages et al.
4,604,515 A 8/1986 Davidson
4,606,325 A 8/1986 Lujan
4,611,757 A 9/1986 Saether
4,628,902 A 12/1986 Comber
4,638,147 A 1/1987 Dytch et al.
4,674,678 A 6/1987 Knebel et al.
4,680,446 A 7/1987 Post
4,682,581 A 7/1987 Laing et al.
4,682,728 A 7/1987 Oudenhoven et al.
4,688,277 A 8/1987 Kakinoki et al.
4,700,884 A 10/1987 Barrett et al.
4,700,885 A 10/1987 Knebel
4,709,728 A 12/1987 Ying-Chung
4,713,525 A 12/1987 Eastep
4,716,605 A 1/1988 Shepherd et al.
4,735,357 A 4/1988 Gregory et al.
4,738,280 A 4/1988 Oberholtzer
4,742,456 A 5/1988 Kamena
4,750,472 A 6/1988 Fazekas
4,753,265 A 6/1988 Barrett et al.
4,756,030 A 7/1988 Juliver
4,757,943 A 7/1988 Sperling et al.
4,761,839 A 8/1988 Ganaway
4,762,273 A 8/1988 Gregory et al.
4,768,705 A 9/1988 Tsutsui et al.
4,786,782 A 11/1988 Takai et al.
4,798,224 A 1/1989 Haws
4,808,793 A 2/1989 Hurko
4,823,414 A 4/1989 Piersimoni et al.
4,832,259 A 5/1989 Vandermeyden
4,845,316 A 7/1989 Kaercher
4,854,498 A 8/1989 Stayton
4,869,287 A 9/1989 Pepper et al.
4,869,427 A 9/1989 Kawamoto et al.
4,870,986 A 10/1989 Barrett et al.
4,872,485 A 10/1989 Laverty
4,875,623 A 10/1989 Garris
4,893,653 A 1/1990 Ferrigno
4,896,658 A 1/1990 Yonekubo et al.
4,901,915 A 2/1990 Sakakibara
4,909,435 A 3/1990 Kidouchi et al.
4,914,758 A 4/1990 Shaw
4,916,613 A 4/1990 Lange et al.
4,917,142 A 4/1990 Laing et al.
4,921,211 A 5/1990 Novak et al.
4,923,116 A 5/1990 Homan
4,930,551 A 6/1990 Haws
4,936,289 A 6/1990 Peterson
4,941,608 A 7/1990 Shimizu et al.
4,945,942 A 8/1990 Lund
4,945,943 A 8/1990 Cogger
4,955,535 A 9/1990 Tsutsui et al.
4,965,894 A 10/1990 Baus
4,967,794 A 11/1990 Tsutsui et al.
4,969,598 A 11/1990 Garris
4,970,373 A 11/1990 Lutz et al.
4,971,106 A 11/1990 Tsutsui et al.
4,981,158 A 1/1991 Brondolino et al.
4,985,944 A 1/1991 Shaw
4,995,585 A 2/1991 Gruber et al.
4,998,673 A 3/1991 Pilolla
5,009,572 A 4/1991 Imhoff et al.
5,012,124 A 4/1991 Hollaway
5,020,127 A 5/1991 Eddas et al.
5,033,508 A 7/1991 Laverty
5,033,715 A 7/1991 Chiang
5,040,106 A 8/1991 Maag
5,042,524 A 8/1991 Lund
5,056,712 A 10/1991 Enck
5,057,214 A 10/1991 Morris
5,058,804 A 10/1991 Yonekubo et al.
5,063,955 A 11/1991 Sakakibara
5,073,991 A 12/1991 Marty
5,074,520 A 12/1991 Lee et al.
5,086,526 A 2/1992 Van Marcke
5,092,560 A 3/1992 Chen
5,095,945 A 3/1992 Jensen
5,105,846 A 4/1992 Britt
5,124,934 A 6/1992 Kawamoto et al.
5,125,433 A 6/1992 DeMoss et al.
5,129,034 A 7/1992 Sydenstricker
5,133,089 A 7/1992 Tsutsui et al.
5,139,044 A 8/1992 Otten et al.
5,143,049 A 9/1992 Laing et al.
5,148,824 A 9/1992 Wilson et al.
5,170,361 A 12/1992 Reed
5,170,514 A 12/1992 Weigert
5,170,816 A 12/1992 Schnieders
5,170,944 A 12/1992 Shirai
5,174,495 A 12/1992 Eichholz et al.
5,175,892 A 1/1993 Shaw
5,183,029 A 2/1993 Ranger
5,184,642 A 2/1993 Powell
5,187,816 A 2/1993 Chiou
5,202,666 A 4/1993 Knippscheer
5,205,318 A 4/1993 Massaro et al.
5,206,963 A 5/1993 Wiens
5,217,035 A 6/1993 Van Marcke
5,224,509 A 7/1993 Tanaka et al.
5,224,685 A 7/1993 Chiang et al.
5,243,717 A 9/1993 Yasuo
D340,279 S 10/1993 Mattis
5,257,341 A 10/1993 Austin et al.
5,261,443 A 11/1993 Walsh
5,262,621 A 11/1993 Hu et al.
5,265,318 A 11/1993 Shero
5,277,219 A 1/1994 Lund
5,281,808 A 1/1994 Kunkel
5,287,570 A 2/1994 Peterson et al.
5,309,940 A 5/1994 Delabie et al.
5,315,719 A 5/1994 Tsutsui et al.
5,322,086 A 6/1994 Sullivan
5,323,803 A 6/1994 Blumenauer
5,325,822 A 7/1994 Fernandez
5,334,819 A 8/1994 Lin
5,341,839 A 8/1994 Kobayashi et al.
5,351,347 A 10/1994 Kunkel
5,351,712 A 10/1994 Houlihan

(56) References Cited

U.S. PATENT DOCUMENTS 5,358,177 A 10/1994 Cashmore
5,361,215 A 11/1994 Tompkins et al.
5,362,026 A 11/1994 Kobayashi et al.
5,385,168 A 1/1995 Lund
5,397,099 A 3/1995 Pilolla
5,400,961 A 3/1995 Tsutsui et al.
5,408,578 A 4/1995 Bolivar
5,419,930 A 5/1995 Schucker
5,429,272 A 7/1995 Luigi
5,437,003 A 7/1995 Blanco
RE35,018 E 8/1995 Homan
5,438,642 A 8/1995 Posen
5,467,967 A 11/1995 Gillooly
5,479,558 A 12/1995 White et al.
5,482,250 A 1/1996 Kodaira
5,504,306 A 4/1996 Russell et al.
5,504,950 A 4/1996 Natalizia et al.
5,511,579 A 4/1996 Price
5,511,723 A 4/1996 Eki et al.
5,540,555 A 7/1996 Corso et al.
5,549,273 A 8/1996 Aharon
5,550,753 A 8/1996 Tompkins et al.
5,551,637 A 9/1996 Lo
5,555,912 A 9/1996 Saadi et al.
5,564,462 A 10/1996 Storch
5,566,702 A 10/1996 Philipp
5,570,869 A 11/1996 Diaz et al.
5,572,985 A 11/1996 Benham
5,577,660 A 11/1996 Hansen
5,584,316 A 12/1996 Lund
5,586,572 A 12/1996 Lund
5,588,636 A 12/1996 Eichholz et al.
5,595,216 A 1/1997 Pilolla
5,595,342 A 1/1997 McNair et al.
5,603,344 A 2/1997 Hall
5,609,370 A 3/1997 Szabo et al.
5,610,589 A 3/1997 Evans et al.
5,622,203 A 4/1997 Givler et al.
5,623,990 A 4/1997 Pirkle
5,627,375 A 5/1997 Hsieh
5,650,597 A 7/1997 Redmayne
5,651,384 A 7/1997 Rudrich
5,655,749 A 8/1997 Mauerhofer
5,682,032 A 10/1997 Philipp
5,694,653 A 12/1997 Harald
5,729,422 A 3/1998 Henke
5,730,165 A 3/1998 Philipp
5,735,291 A 4/1998 Kaonohi
5,743,511 A 4/1998 Eichholz et al.
5,755,262 A 5/1998 Pilolla
5,758,688 A 6/1998 Hamanaka et al.
5,758,690 A 6/1998 Humpert et al.
5,769,120 A 6/1998 Laverty et al.
5,771,501 A 6/1998 Shaw
5,775,372 A 7/1998 Houlihan
5,784,531 A 7/1998 Mann et al.
5,790,024 A 8/1998 Ripingill et al.
5,812,059 A 9/1998 Shaw et al.
5,813,655 A 9/1998 Pinchott et al.
5,819,366 A 10/1998 Edin
5,829,467 A 11/1998 Spicher
5,829,475 A 11/1998 Acker
5,845,844 A 12/1998 Zosimodis
5,855,356 A 1/1999 Fait
5,857,717 A 1/1999 Caffrey
5,868,311 A 2/1999 Cretu-Petra
5,872,891 A 2/1999 Son
5,893,387 A 4/1999 Paterson et al.
5,915,417 A 6/1999 Diaz et al.
5,918,855 A 7/1999 Hamanaka et al.
5,934,325 A 8/1999 Brattoli et al.
5,941,275 A 8/1999 Laing
5,941,504 A 8/1999 Toma et al.
5,943,713 A 8/1999 Paterson et al.
5,944,221 A 8/1999 Laing et al.
5,961,095 A 10/1999 Schrott
5,963,624 A 10/1999 Pope
5,966,753 A 10/1999 Gauthier et al.
5,973,417 A 10/1999 Goetz et al.
5,979,776 A 11/1999 Williams
5,983,922 A 11/1999 Laing et al.
5,988,593 A 11/1999 Rice
6,000,170 A 12/1999 Davis
6,003,170 A 12/1999 Humpert et al.
6,003,182 A 12/1999 Song
6,006,784 A 12/1999 Tsutsui et al.
6,019,130 A 2/2000 Rump
6,026,844 A 2/2000 Laing et al.
6,029,094 A 2/2000 Diffut
6,032,616 A 3/2000 Jones
6,042,885 A 3/2000 Woollard et al.
6,059,192 A 5/2000 Zosimadis
6,061,499 A 5/2000 Hlebovy
6,075,454 A 6/2000 Yamasaki
6,082,407 A 7/2000 Paterson et al.
6,101,452 A 8/2000 Krall et al.
6,125,482 A 10/2000 Foster
6,132,085 A 10/2000 Bergeron
6,167,845 B1 1/2001 Decker, Sr.
6,175,689 B1 1/2001 Blanco, Jr.
6,182,683 B1 2/2001 Sisk
6,192,192 B1 2/2001 Illy et al.
6,195,588 B1 2/2001 Gauthier et al.
6,202,980 B1 3/2001 Vincent et al.
6,220,297 B1 4/2001 Marty et al.
6,227,235 B1 5/2001 Laing et al.
6,240,250 B1 5/2001 Blanco, Jr.
6,250,558 B1 6/2001 Dogre Cuevas
6,250,601 B1 6/2001 Kolar et al.
6,273,394 B1 8/2001 Vincent et al.
6,283,139 B1 9/2001 Symonds et al.
6,286,764 B1 9/2001 Garvey et al.
6,288,707 B1 9/2001 Philipp
6,290,139 B1 9/2001 Kolze
6,294,786 B1 9/2001 Marcichow et al.
6,315,208 B1 11/2001 Doyle
6,317,717 B1 11/2001 Lindsey et al.
6,321,785 B1 11/2001 Bergmann
6,337,635 B1 1/2002 Ericksen et al.
6,340,032 B1 1/2002 Zosimadis
6,341,389 B2 1/2002 Philipps-Liebich et al.
6,351,603 B2 2/2002 Waithe et al.
6,363,549 B2 4/2002 Humpert et al.
6,373,265 B1 4/2002 Morimoto et al.
6,377,009 B1 4/2002 Philipp
6,381,770 B1 5/2002 Raisch
6,389,226 B1 5/2002 Neale et al.
6,438,770 B1 8/2002 Hed et al.
6,445,306 B1 9/2002 Trovato et al.
6,446,875 B1 9/2002 Brooks et al.
6,452,514 B1 9/2002 Philipp
RE37,888 E 10/2002 Cretu-Petra
6,457,355 B1 10/2002 Philipp
6,466,036 B1 10/2002 Philipp
6,473,917 B1 11/2002 Mateina
6,474,951 B2 11/2002 Stephan et al.
6,513,787 B1 2/2003 Jeromson et al.
6,522,078 B1 2/2003 Okamoto et al.
6,535,134 B2 3/2003 Lang et al.
6,535,200 B2 3/2003 Philipp
6,536,464 B1 3/2003 Lum et al.
6,549,816 B2 4/2003 Gauthier et al.
6,574,426 B1 6/2003 Blanco, Jr.
6,588,377 B1 7/2003 Leary et al.
6,588,453 B2 7/2003 Marty et al.
6,612,267 B1 9/2003 West
6,619,320 B2 9/2003 Parsons
6,622,930 B2 9/2003 Laing et al.
6,629,645 B2 10/2003 Mountford et al.
6,639,209 B1 10/2003 Patterson et al.
6,644,333 B2 11/2003 Gloodt
6,659,048 B1 12/2003 DeSantis et al.
6,676,024 B1 1/2004 McNerney et al.
6,684,822 B1 2/2004 Lieggi

(56) References Cited

U.S. PATENT DOCUMENTS 6,691,338 B2 2/2004 Zieger
6,705,534 B1 3/2004 Mueller
6,707,030 B1 3/2004 Watson
6,734,685 B2 5/2004 Rudrich
6,738,996 B1 5/2004 Malek et al.
6,757,921 B2 7/2004 Esche
6,768,103 B2 7/2004 Watson
6,770,869 B2 8/2004 Patterson et al.
6,779,552 B1 8/2004 Coffman
6,838,887 B2 1/2005 Denen et al.
6,845,526 B2 1/2005 Malek et al.
6,877,172 B2 4/2005 Malek et al.
6,892,952 B2 5/2005 Chang et al.
6,895,985 B2 5/2005 Popper et al.
6,913,203 B2 7/2005 DeLangis
6,955,333 B2 10/2005 Patterson et al.
6,956,498 B1 10/2005 Gauthier et al.
6,962,162 B2 11/2005 Acker
6,962,168 B2 11/2005 McDaniel et al.
6,964,404 B2 11/2005 Patterson et al.
6,964,405 B2 11/2005 Marcichow et al.
6,968,860 B1 11/2005 Haenlein et al.
6,993,607 B2 1/2006 Philipp
6,995,670 B2 2/2006 Wadlow et al.
6,998,545 B2 2/2006 Harkcom et al.
7,006,078 B2 2/2006 Kim
7,014,166 B1 3/2006 Wang
7,015,704 B1 3/2006 Lang
7,025,077 B2 4/2006 Vogel
7,030,860 B1 4/2006 Hsu et al.
7,063,103 B2 * 6/2006 Guler et al. ..... 137/269
7,069,357 B2 6/2006 Marx et al.
7,069,941 B2 7/2006 Parsons et al.
7,083,156 B2 8/2006 Jost et al.
7,096,517 B2 8/2006 Gubeli et al.
7,099,649 B2 8/2006 Patterson et al.
D528,991 S 9/2006 Katsuyama
7,102,366 B2 9/2006 Denen et al.
7,107,631 B2 9/2006 Lang et al.
7,124,312 B2 10/2006 Casebolt et al.
7,150,293 B2 12/2006 Jonte
7,156,363 B2 1/2007 Parsons et al.
7,174,577 B2 2/2007 Jost et al.
7,174,579 B1 2/2007 Bauza
7,232,111 B2 6/2007 McDaniels et al.
7,278,624 B2 10/2007 Iott et al.
7,307,485 B1 12/2007 Snyder et al.
7,537,023 B2 5/2009 Marty et al.
7,537,195 B2 5/2009 McDaniels et al.
7,631,372 B2 12/2009 Marty et al.
7,690,395 B2 4/2010 Jonte et al.
7,690,623 B2 4/2010 Parsons et al.
7,731,154 B2 6/2010 Parsons et al.
7,766,026 B2 8/2010 Boey
7,784,481 B2 8/2010 Kunkel
7,921,480 B2 4/2011 Parsons et al.
2001/0011389 A1 8/2001 Philipps-Liebich et al.
2001/0011390 A1 8/2001 Humpert et al.
2001/0011558 A1 8/2001 Schumacher
2001/0011560 A1 8/2001 Pawelzik et al.
2001/0022352 A1 9/2001 Rudrich
2002/0007510 A1 1/2002 Mann
2002/0015024 A1 2/2002 Westerman et al.
2002/0113134 A1 8/2002 Laing et al.
2002/0117122 A1 8/2002 Lindner
2002/0148040 A1 10/2002 Mateina
2002/0175789 A1 11/2002 Pimouguet
2002/0179723 A1 12/2002 Wack et al.
2003/0041374 A1 3/2003 Franke
2003/0080194 A1 5/2003 O'Hara et al.
2003/0088338 A1 5/2003 Phillips et al.
2003/0089399 A1 5/2003 Acker
2003/0125842 A1 7/2003 Chang et al.
2003/0126993 A1 7/2003 Lassota et al.
2003/0185548 A1 10/2003 Novotny et al.
2003/0201018 A1 10/2003 Bush
2003/0213062 A1 11/2003 Honda et al.
2003/0234769 A1 12/2003 Cross et al.
2004/0011399 A1 1/2004 Segien, Jr.
2004/0041033 A1 3/2004 Kemp
2004/0041034 A1 3/2004 Kemp
2004/0041110 A1 3/2004 Kaneko
2004/0061685 A1 4/2004 Ostergard et al.
2004/0088786 A1 5/2004 Malek et al.
2004/0135010 A1 7/2004 Malek et al.
2004/0143898 A1 7/2004 Jost et al.
2004/0144866 A1 7/2004 Nelson et al.
2004/0149643 A1 8/2004 Vandenbelt et al.
2004/0155116 A1 8/2004 Wack et al.
2004/0206405 A1 10/2004 Smith et al.
2004/0212599 A1 10/2004 Cok et al.
2004/0262552 A1 12/2004 Lowe
2005/0001046 A1 1/2005 Laing
2005/0006402 A1 1/2005 Acker
2005/0022871 A1 2/2005 Acker
2005/0044625 A1 3/2005 Kommers
2005/0086958 A1 4/2005 Walsh
2005/0117912 A1 6/2005 Patterson et al.
2005/0121529 A1 6/2005 DeLangis
2005/0125083 A1 6/2005 Kiko
2005/0127313 A1 6/2005 Watson
2005/0146513 A1 7/2005 Hill et al.
2005/0150552 A1 7/2005 Forshey
2005/0150556 A1 7/2005 Jonte
2005/0150557 A1 7/2005 McDaniel et al.
2005/0151101 A1 7/2005 McDaniel et al.
2005/0194399 A1 9/2005 Proctor
2005/0199841 A1 9/2005 O'Maley
2005/0199843 A1 9/2005 Jost et al.
2005/0205818 A1 9/2005 Bayley et al.
2005/0253102 A1 11/2005 Boilen
2005/0273218 A1 12/2005 Breed et al.
2006/0066991 A1 3/2006 Hirano et al.
2006/0101575 A1 5/2006 Louis
2006/0130907 A1 6/2006 Marty et al.
2006/0130908 A1 6/2006 Marty et al.
2006/0138246 A1 6/2006 Stowe et al.
2006/0145111 A1 7/2006 Lang et al.
2006/0153165 A1 7/2006 Beachy
2006/0186215 A1 8/2006 Logan
2006/0200903 A1 9/2006 Rodenbeck et al.
2006/0201558 A1 9/2006 Marty et al.
2006/0202142 A1 9/2006 Marty et al.
2006/0207019 A1 9/2006 Vincent
2006/0212016 A1 9/2006 Lavon et al.
2006/0214016 A1 9/2006 Erdely et al.
2006/0231638 A1 10/2006 Belz et al.
2006/0231782 A1 10/2006 Iott et al.
2006/0231788 A1 10/2006 Cheng
2006/0237674 A1 10/2006 Iott et al.
2006/0283511 A1 12/2006 Nelson
2007/0001018 A1 1/2007 Schmitt et al.
2007/0057215 A1 3/2007 Parsons et al.
2007/0069168 A1 3/2007 Jonte
2007/0069169 A1 3/2007 Lin
2007/0114073 A1 5/2007 Akel et al.
2007/0138421 A1 6/2007 Gibson et al.
2007/0156260 A1 7/2007 Rodenbeck et al.
2007/0157978 A1 * 7/2007 Jonte et al. ..... 137/613
2007/0170384 A1 * 7/2007 Goodman ..... 251/129.04
2007/0187635 A1 8/2007 Jost
2007/0246267 A1 10/2007 Koottungal
2007/0246550 A1 10/2007 Rodenbeck et al.
2007/0246564 A1 10/2007 Rodenbeck et al.
2008/0078019 A1 4/2008 Allen et al.
2008/0099088 A1 5/2008 Boey
2008/0109956 A1 5/2008 Bayley et al.
2008/0178950 A1 7/2008 Marty et al.
2008/0271238 A1 11/2008 Reeder et al.
2008/0289098 A1 11/2008 Kunkel
2009/0039176 A1 2/2009 Davidson et al.
2009/0119832 A1 5/2009 Conroy
2009/0160659 A1 6/2009 Bailey
2009/0288712 A1 11/2009 Lang et al.

(56) References Cited

U.S. PATENT DOCUMENTS

| | | | |
|---|---|---|---|
| 2009/0293192 | A1 | 12/2009 | Pons |
| 2010/0012194 | A1 | 1/2010 | Jonte et al. |
| 2010/0044604 | A1 | 2/2010 | Burke et al. |
| 2010/0096017 | A1 | 4/2010 | Jonte et al. |
| 2010/0170570 | A1 | 7/2010 | Rodenbeck et al. |
| 2010/0275359 | A1 | 11/2010 | Guler et al. |

FOREIGN PATENT DOCUMENTS

| | | | |
|---|---|---|---|
| DE | 04401637 | | 5/1998 |
| DE | 19815324 | | 11/2000 |
| EP | 0961067 | B1 | 12/1999 |
| EP | 1 134 895 | | 9/2001 |
| JP | 63111383 | | 5/1998 |
| JP | 200073426 | | 3/2000 |
| JP | 2003-20703 | A | 1/2003 |
| JP | 2003105817 | | 4/2003 |
| JP | 2003293411 | | 10/2003 |
| JP | 2004-92023 | | 3/2004 |
| JP | 2005-146551 | A | 6/2005 |
| KR | 10-1997-0700266 | | 1/1997 |
| KR | 2003-0077823 | | 10/2003 |
| KR | 20-0382786 | Y1 | 4/2005 |
| WO | WO 91/17377 | | 11/1991 |
| WO | WO 96 14477 | | 5/1996 |
| WO | WO 01/20204 | | 3/2001 |
| WO | WO 2004/094990 | | 11/2004 |
| WO | WO 2005/057086 | | 6/2005 |
| WO | WO 2006/098795 | | 9/2006 |
| WO | WO 2006/136256 | | 12/2006 |
| WO | WO 2007/059051 | | 5/2007 |
| WO | WO 2007/124311 | | 11/2007 |
| WO | WO 2007/124438 | | 11/2007 |
| WO | WO 2008/088534 | | 7/2008 |
| WO | WO 2008/094247 | | 8/2008 |
| WO | WO 2008/094651 | | 8/2008 |
| WO | WO 2008/118402 | | 10/2008 |
| WO | WO 2009/075858 | | 6/2009 |
| WO | WO 2009/095879 | | 8/2009 |

OTHER PUBLICATIONS

Dallmer Manutronic brochure, "The First Electronic mixer-taps that your hands can orchestrate," Dallmer Handel GmbH, at least as early as Jan. 31, 2008, 12 pgs.
International Search Report and Written Opinion for PCT/US2007/025336, 5 pages.
International Search Report and Written Opinion for PCT/US2008/67116, 9 pages.
KWC AG, Kitchen Faucet 802285 Installation and Service Instructions, dated Jul. 2005, 8 pgs.
Philipp, Hal, "Tough Touch Screen," applicanceDESIGN, Feb. 2006.
Quantum Research Group, "E401 User Manual," 15 pgs.
Quantum Research Group, "Gorenje Puts QSlideTM Technology into Next-Generation Kitchen Hob," Feb. 8, 2006, http://www.qprox.com/news/gorenje.php, 3 pgs.
Quantum Research Group, "Qprox™ Capacitive Touch Applications," http://www.qprox.com/background/applications.php, 8 pgs.
Quantum Research Group, "QT401 QSlide™ Touch Slider IC," 2004, 16 pgs.
Quantum Research Group, "QT411-ISSG QSlide™ Touch Slider IC," 2004-2005, 12 pgs.
Sequine et al., Cypress Perform, "Application Notes AN2292," Oct. 31, 2005, 15 pgs.
Sequine et al., Cypress Perform, "Application Notes AN2233a," Apr. 14, 2005, 6 pgs.
SLOAN® Optima® i.q. Electronic Hand Washing Faucet, Apr. 2004, 2 pgs.
Symmons, Ultra-Sense, Battery-Powered Faucets with PDS and Ultra-Sense AC Powered Faucets, © 1999-2004, 2 pgs.
Symmons, Ultra-Sense, Sensor Faucet with Position-Sensitive Detection, © 2001-2002, 2 pgs.
Symmons® Commercial Faucets: Reliability With a Sense of Style, 1 pg.
Symmons®, "Ultra-Sense® Battery-Powered, Sensor-Operated Lavatory Faucet S-6080 Series," Oct. 2002, 4 pgs.
Symmons®, "Ultra-Sense® Sensor Faucets with Position-Sensitive Detection," Aug. 2004, 4 pgs.
Technical Concepts International, Inc., Capri AutoFaucet® with Surround Sensor™ Technology, 500556, 500576, 500577, (undated), 1 pg.
Technical Concepts, AutoFaucet® with "Surround Sensor" Technology, Oct. 2005, 4 pgs.
TOTO® Products, "Self-Generating EcoPower System Sensor Faucet, Standard Spout," Specification Sheet, Nov. 2002, 2 pgs.
Various Products (available at least before Apr. 20, 2006), 5 pgs.
Villeroy & Boch "Magic Faucet," 2 pgs.
Villeroy & Boch web pages, "Magic Basin," 2 pgs., downloaded from http://www.villeroy-boch.com on Dec. 27, 2006.
Zurn® Plumbing Products Group, "AquaSense® Sensor Faucet," Jun. 9, 2004, 2 pgs.
Zurn® Plumbing Products Group, "AquaSense® Z6903 Series", Installation, Operation, Maintenance and Parts Manual, Aug. 2001, 5 pgs.
International Search Report and Written Opinion for PCT/US2008/001288 issued by the Korean Patent Office, Jun. 18, 2008 (9 pages).

* cited by examiner

CAPACITIVE SENSING APPARATUS AND METHOD FOR FAUCETS

CROSS-REFERENCE TO RELATED APPLICATIONS

This application is a U.S. National Phase Application of PCT International Application No. PCT/US2008/001288, filed on Jan. 31, 2008, which claims the benefit of U.S. Provisional Application Nos. 60/898,524 and 60/898,525, both filed on Jan. 31, 2007, all the disclosures of which are expressly incorporated by reference herein.

BACKGROUND AND SUMMARY OF THE INVENTION

The present invention relates to improvements in the placement of capacitive sensors for hands free activation of faucets. More particularly, the present invention relates to the placement of capacitive sensors in or adjacent to faucet spouts, faucet handles, and/or sink basins to sense the presence of users of the faucet and then controlling the faucet based on output signals from the capacitive sensors.

In one illustrated embodiment, a fluid delivery apparatus includes a spout made at least partially from a non-conductive material, a fluid supply conduit supported by the spout, and a capacitive sensor coupled to the non-conductive material of the spout. The capacitive sensor generates a capacitive sensing field. The apparatus also includes a controller coupled to the capacitive sensor to detect a user's presence in the capacitive sensing field.

In an illustrated embodiment, the capacitive sensor includes a first sensor probe coupled to the non-conductive material of the spout and a second sensor probe spaced apart from the first sensor probe to define the capacitive sensing field therebetween. The second sensor probe may be coupled to a sink basin which supports the spout. In an illustrated embodiment, the capacitive sensor is embedded in the non-conductive material of the spout. In another illustrated embodiment, the capacitive sensor is coupled to an outer surface of the spout.

In another illustrated embodiment, the fluid supply conduit is also made from a non-conductive material. The fluid supply conduit may be separate from the spout.

In yet another illustrated embodiment, a fluid delivery apparatus includes a spout, a sink basin supporting the spout, a fluid supply conduit supported by the spout, and a capacitive sensor system including a first sensor probe coupled to the spout and a second sensor probe coupled to the sink basin to define a sensing field between the first and second sensor probes. The capacitive sensor system is configured to detect changes in a dielectric constant within the sensing field. The apparatus also includes a controller coupled to the capacitive sensor system and configured to control the amount of fluid supplied to the fluid supply conduit based on an output from the capacitive sensor system.

In still another illustrated embodiment, a fluid delivery apparatus includes a spout, a fluid conduit supported by the spout, and first, second, and third capacitive sensors coupled to the spout. The apparatus also includes a controller coupled to the first, second and third capacitive sensors. The first capacitive sensor generates a capacitive sensing field to provide a proximity detector adjacent the spout. The controller provides a hands-free supply of fluid through the fluid supply conduit in response to detecting a user's presence in the capacitive sensing field of the first capacitive sensor. The controller is configured to increase the temperature of the fluid supplied to the fluid supply conduit in response to detecting a user's presence adjacent the second capacitive sensor. The controller is also configured to decrease the temperature of the fluid supplied to the fluid supply conduit in response to detecting a user's presence adjacent the third capacitive sensor.

In an illustrated embodiment, a fourth capacitive sensor is coupled to the spout. The fourth capacitive sensor is also coupled to the controller. The controller is configured to switch the control of fluid delivery from the hands-free proximity sensing mode to a manual control mode in response to detecting a user's presence adjacent the fourth capacitive sensor.

In one illustrated embodiment, the first, second, third, and fourth sensors are selectively coupled to the controller by switches so that the controller alternatively monitors the outputs from the first, second, third and fourth sensors. In another illustrated embodiment, the controller simultaneously monitors the first, second, third, and fourth sensors. The first, second, third, and fourth sensors may be coupled to the controller through capacitors having different capacitance values so that the controller can distinguish the outputs from the first, second, third, and fourth sensors. The first, second, third, and fourth sensors may also be coupled to the controller through resistors having different resistance values so that the controller can distinguish the outputs from the first, second, third, and fourth sensors.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

For the purposes of promoting an understanding of the principles of the invention, reference will now be made to certain illustrated embodiments and specific language will be used to describe the same. It will nevertheless be understood that no limitation of the scope of the invention is thereby intended. Such alterations and further modifications of the invention, and such further applications of the principles of the invention as described herein as would normally occur to one skilled in the art to which the invention pertains, are contemplated, and desired to be protected.

Figure 1:
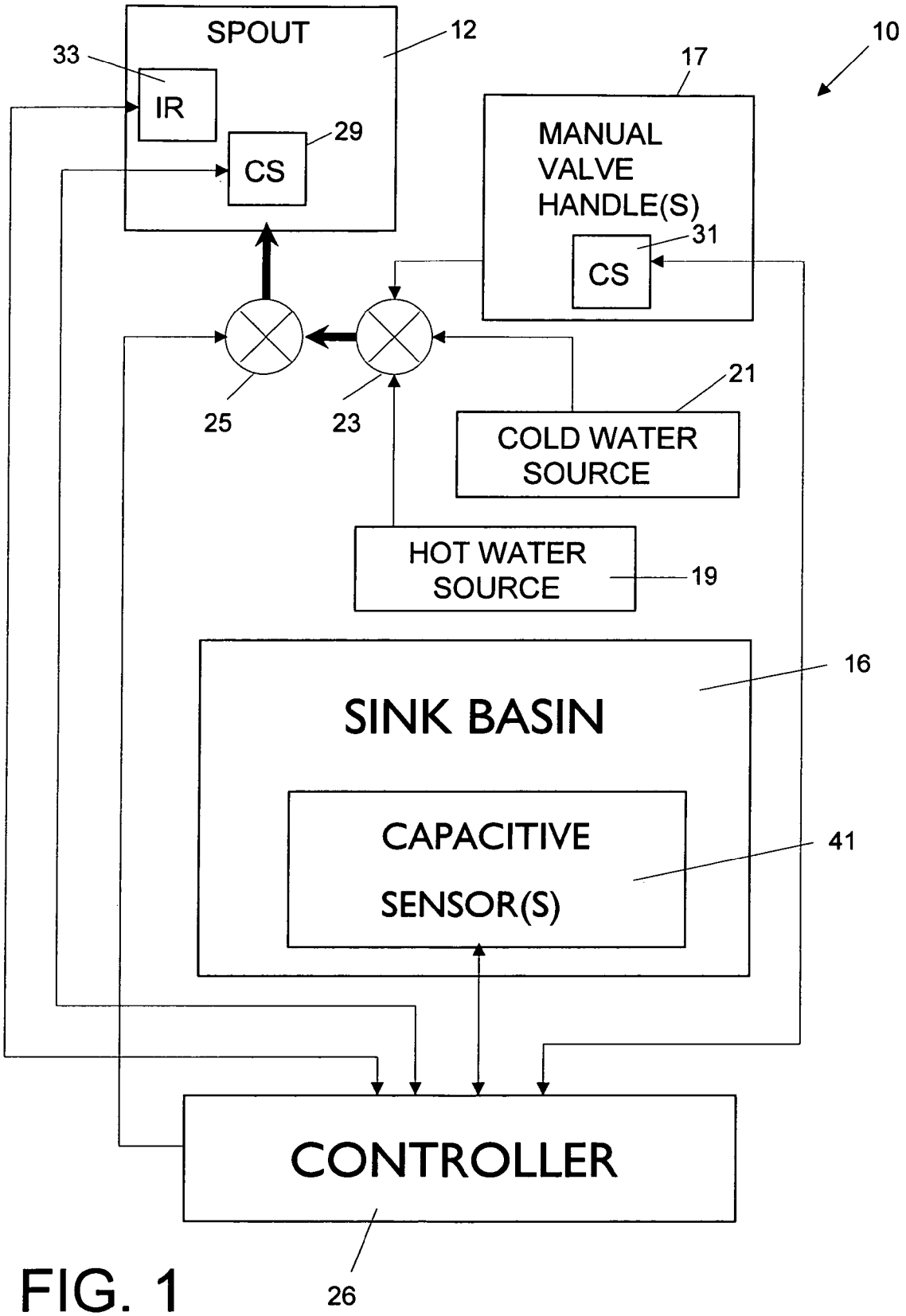
FIG. 1 is a block diagram of a fluid delivery assembly including a sensor system.

FIG. 1 is a block diagram illustrating one embodiment of a sensing faucet system 10 of the present invention. The system 10 includes a sink basin 16, a spout 12 for delivering water into the basin 16 and at least one manual valve handle 17 for controlling the flow of water through the spout 12 in a manual mode. A hot water source 19 and cold water source 21 are coupled to a valve body assembly 23. In one illustrated embodiment, separate manual valve handles 17 are provided for the hot and cold water sources 19, 21. In other embodiments, such as a kitchen embodiment, a single manual valve handle 17 is used for both hot and cold water delivery. In such kitchen embodiment, the manual valve handle 17 and spout 12 are typically coupled to the basin 16 through a single hole mount. An output of valve body assembly 23 is coupled to an actuator driven valve 25 which is controlled electronically by input signals from a controller 26. In an illustrative embodiment, actuator driven valve 25 is a magnetically latching pilot-controlled solenoid valve.

In an alternative embodiment, the hot water source 19 and cold water source 21 may be connected directly to actuator driven valve 25 to provide a fully automatic faucet without any manual controls. In yet another embodiment, the controller 26 controls an electronic proportioning valve (not shown) to supply water for the spout 12 from hot and cold water sources 19, 21.

Because the actuator driven valve 25 is controlled electronically by controller 26, flow of water can be controlled using outputs from sensors as discussed herein. As shown in FIG. 1, when the actuator driven valve 25 is open, the faucet system may be operated in a conventional manner, i.e., in a manual control mode through operation of the handle(s) 17 and the manual valve member of valve body assembly 23. Conversely, when the manually controlled valve body assembly 23 is set to select a water temperature and flow rate, the actuator driven valve 25 can be touch controlled, or activated by proximity sensors when an object (such as a user's hands) are within a detection zone to toggle water flow on and off.

Spout 12 may have capacitive sensors 29 and/or an IR sensor 33 connected to controller 26. In addition, the manual valve handle(s) 17 may also have capacitive sensor(s) 31 mounted thereon which are electrically coupled to controller 26.

In illustrative embodiments of the present invention, capacitive sensors 41 may also be coupled to the sink basin 16 in various orientations as discussed below. In illustrated embodiments of the present invention, capacitive sensors 29, 31, 41 are placed on an exterior wall of the spout 12, handle 17, or basin 16, respectively, or embedded into the wall of the spout 12, handle 17 or basin 16, respectively. Output signals from the capacitive sensors 41 are also coupled to controller 26. The output signals from capacitive sensors 29, 31 or 41 are therefore used to control actuator driven valve 25 which thereby controls flow of water to the spout 12 from the hot and cold water sources 19 and 21. Capacitive sensors 41 can also be used to determine how much water is in the basin 16 to shut off the flow of water when the basin 16 reaches a pre-determined fill level.

Each sensor 29, 31, 41 may include an electrode which is connected to a capacitive sensor such as a timer or other suitable sensor as discussed herein. By sensing capacitance changes with capacitive sensors 29, 31, 41 controller 26 can make logical decisions to control different modes of operation of system 10 such as changing between a manual mode of operation and a hands free mode of operation as described in U.S. application Ser. No. 11/641,574; U.S. application Ser. No. 10/755,581; U.S. application Ser. No. 11/325,128; U.S. Provisional Application Ser. No. 60/662,107; and U.S. Provisional Application Ser. No. 60/898,525, the disclosures of which are all expressly incorporated herein by reference. Another illustrated configuration for a proximity detector and logical control for the faucet in response to the proximity detector is described in greater detail in U.S. patent application Ser. No. 10/755,582, which is hereby incorporated by reference in its entirety.

The amount of fluid from hot water source 19 and cold water source 21 is determined based on one or more user inputs, such as desired fluid temperature, desired fluid flow rate, desired fluid volume, various task based inputs (such as vegetable washing, filling pots or glasses, rinsing plates, and/or washing hands), various recognized presentments (such as vegetables to wash, plates to wash, hands to wash, or other suitable presentments), and/or combinations thereof. As discussed above, the system 10 may also include electronically controlled mixing valve which is in fluid communication with both hot water source 19 and cold water source 21. Exemplary electronically controlled mixing valves are described in U.S. Patent Application Ser. No. 11/109,281 and U.S. Provisional Patent Application Ser. No. 60/758,373, filed Jan. 12, 2006, the disclosures of which are expressly incorporated by reference herein.

Figure 2:
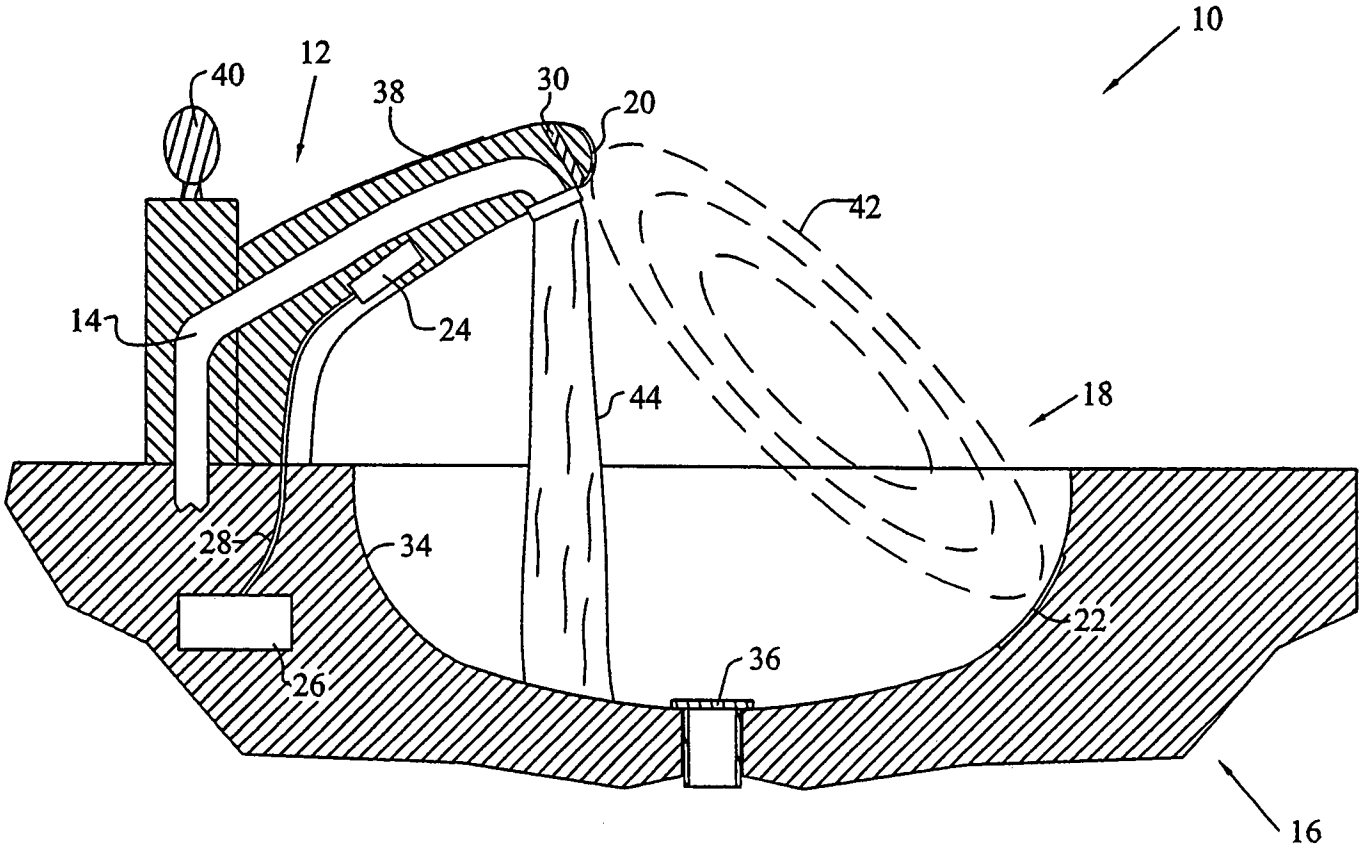
FIG. 2 is a cross-sectional view of a fluid delivery assembly and a sink basin including a sensor system.

Now referring to FIG. 2, an illustrative embodiment sensing faucet system 10 includes a delivery spout 12, a water supply conduit 14, a sink basin 16 and capacitive sensor system 18. In one embodiment delivery spout 12 is illustratively formed from a non-conductive material. More particularly, the spout 12 may be molded from a polymer, such as a thermoplastic or a cross-linkable material, and illustratively a cross-linkable polyethylene (PEX). Further illustrative non-metallic materials include cross-linked polyamide, polybutylene terephthalate (PBT) and thermosets, such as polyesters, melamine, melamine urea, melamine phenolic, and phenolic.

Figure 4:
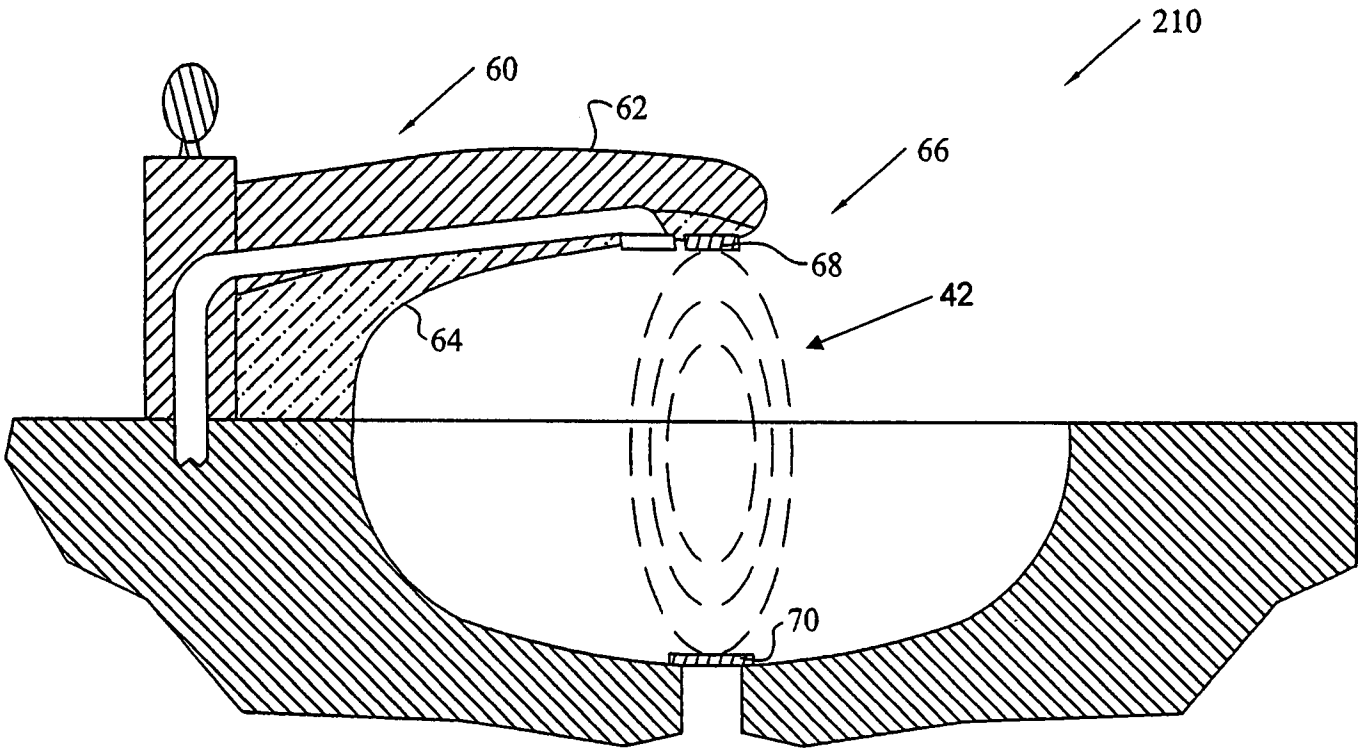
FIG. 4 is a cross-sectional view of a fluid delivery assembly and sink basin including another sensor system.

While FIG. 2 illustratively shows delivery spout 12 formed from non-conductive material, it is understood that delivery spout 12 may include a conductive material as discussed in more detail illustratively shown in FIG. 4. For example, spout 12 may be formed of traditional metallic materials, such as zinc or brass, in certain illustrated embodiments. Spout 12 may also have selective metal plating over the non-conductive material.

Delivery spout 12 supports water supply conduit 14. Fluid supply conduit 14 provides hot water from hot water supply source 19, cold water from cold water source 21 or a mixture of hot and cold water. Fluid supply conduit 14 is also illustratively formed from a non-conductive material. In the illustrative embodiment, fluid supply conduit 14 is formed of compatible materials, such as polymers, and illustratively of cross-linkable materials. As such, the fluid supply conduit 14 is illustratively electrically non-conductive. As used within this disclosure, a cross-linkable material illustratively includes thermoplastics and mixtures of thermoplastics and thermosets. In one illustrative embodiment, the fluid supply conduit 14 is formed of a polyethylene which is subsequently cross-linked to form cross-linked polyethylene (PEX). However, it should be appreciated that other polymers may be substituted therefor. For example, the fluid supply conduit 14 may be formed of any polyethylene (PE)(such as raised temperature resistant polyethylene (PE-RT)), of polypropylene (PP)(such as polypropylene random (PPR)), or of polybutylene (PB). It is further envisioned that the fluid supply conduit 14 may be formed of cross-linked polyvinyl chloride (PVCX) using silane free radical initiators, of cross-linked polyurethane, or of cross-linked propylene (XLPP) using peroxide or silane free radical initiators. Further details of the non-conductive spout and water supply conduit are provided in U.S. application Ser. No. 11/700,634 and U.S. application Ser. No. 11/700,586, the disclosures of which are all expressly incorporated herein by reference.

It is understood that manually controlled valve body assembly 23 and actuator driven valve 25 control the amount of fluid from hot water source 19 and cold water source 21, as previously mentioned. As discussed above, an electronic proportioning valve may also be used. While FIG. 2 illustratively shows a single water supply conduit 14, it is envisioned that a plurality of water supply conduits such as a first conduit for a first flow configuration and a second conduit for a second flow configuration may be used. Exemplary configurations include water conduits that provide a stream flow and a spray flow.

Also illustrated in FIG. 2, delivery spout 12 optionally includes user input devices, such as for example, devices 38 and/or 40. In one embodiment, user input device 38 is a touch sensor which permits a user of system 10 to specify one or more parameters of the water to be delivered, such as temperature, pressure, quantity, and/or flow pattern characteristics by tapping or grabbing the touch sensor. User input device 40 may include task inputs, temperature slider controls, and/or flow rate slider controls. In other embodiments, user input device 40 includes either touch sensitive valve handle or one or more mechanical inputs, such as buttons, dials, and/or handles.

Capacitive sensor system 18 includes a first sensor probe 20 illustratively supported by delivery spout 12, and a second sensor probe 22 illustratively shown as supported by sink basin 16. Controller 26 is operably coupled to both first sensor probe 20 and second sensor probe 22. It is understood that first sensor probe 20 need not be supported by delivery spout 12, as discussed in more detail in other embodiments. It is also understood that second sensor probe 22 need not be supported by sink basin 16, as discussed in more detail in other embodiments. Also as illustrated in FIG. 2, an electrical connector 28 connects electronic circuitry 24 to controller 26. A second electrical connector (not shown) connects circuitry 24 to first sensor probe 20 and second sensor probe 22. Alternatively, wireless connections may be provided. Capacitive sensor system 18 optionally includes a metallic plate 30 also supported by delivery spout 12 to provide shielding between probe 20 and the water supply conduit 14.

The use of non-conductive material for delivery spout 12 enables the first sensor probe 20 and metallic plate 30 to be enclosed within delivery spout 12, which improves the aesthetic value of delivery spout 12. The use of non-conductive material for delivery spout 12 and waterway 14 also reduces or eliminates the need for electrical isolation of capacitive sensor system 18 from a conductive spout or a conductive waterway, thereby improving operation. While FIG. 2 illustratively shows first sensor probe 20 embedded in spout 12. First sensor probe 20 may also be mounted on the surface of spout 12 or in any other suitable configuration.

Sink basin 16 includes drain plug 36. Sink basin 16 supports delivery spout 12 and defines water bowl 34. As illustrated in FIG. 2, second sensor probe 22 is supported by sink basin 16 and adjacent to water bowl 34. Sink basin 16 is also preferably formed from a non-conductive material. However it should be recognized that second sensor probe 22 may be located in any location desirable for detecting a change in dielectric constant. Exemplary sensor locations are described in and U.S. Provisional Application Ser. No. 60/898,525, the disclosure of which is expressly incorporated by reference herein.

Capacitive sensor system 18 monitors a sensing field 42 defined between probes 20 and 22. It is understood that the size and shape of first and second sensor probes 20 and 22 may be modified to optimize the size and shape of sensing field 42. In one embodiment, metallic plate 30 is located between first sensor probe 20 and water supply conduit 14 to provide shielding therebetween. Controller 26 illustratively provides an output signal to metallic plate 30 which matches a signal applied to first sensor probe 20. In such an optional configuration, metallic plate 30 substantially shields sensing field 42 from the effects of water flowing through in water supply conduit 14. Metallic plate 30 is illustratively located on the opposite side of first sensor probe 20 in relation to second sensor probe 22. In such an optional configuration metallic plate 30 substantially directs sensing field 42 between first sensing probe 20 and second sensor probe 22.

As illustrated in FIG. 2, sensing field 42 is at least partially disposed within sink basin 34. As previously discussed, first and second sensor probes 20 and 22 are not limited to the illustrated locations, but may be located anywhere. Sensing field 42 may be shaped to monitor other areas adjacent the sink basin 16 or spout 12.

In operation, capacitive sensor system 18 creates a multiple probe capacitive sensor which directs sensing field 42 substantially between first sensor probe 20 and second sensor probe 22. When hands are presented within sensing field 42, electronic circuitry 24 and controller 26 sense an increase in capacitance. Controller 26 is programmed to detect the changes in capacitance and to control a valve to provide water flow 44 from water supply conduit 14.

Controller 26 may also configured to sense water overfill in bowl 34 of sink basin 16 and to shut off water flow 44. Before water 44 fills bowl 34, water 44 may be located within sensing field 42. In other words, second sensor probe 22 may be located such that capacitive sensor system 18 works as a water overfill sensor and shutoff device.

When a user's hands are placed into the sensing field 42, the capacitance to earth ground detected by capacitive sensors increases. Controller 26 receives the output signal and determines whether to turn on or off the water based on changes in capacitance to earth ground. In one embodiment, a timer circuit, such as a 555 timer chip is used as the capacitive sensor in combination with sensing probes 20, 22 as discussed in detail below. Resistance values are selected to oscillate with typical capacitance to earth ground from a sink basin 16. The frequency of the output signal of the timer changes with changes in capacitance. Timer may be a IMC 7555 CBAZ chip. It is understood that other types of sensors that may be used in accordance with the present invention including, for example, QPROX™ sensors from Quantum Research Group, Oblamatik sensors, or other types of capacitive sensors from other manufacturers such as Analog Devices AD7142 chip or Cypress Semiconductor Corporation.

Figure 3:
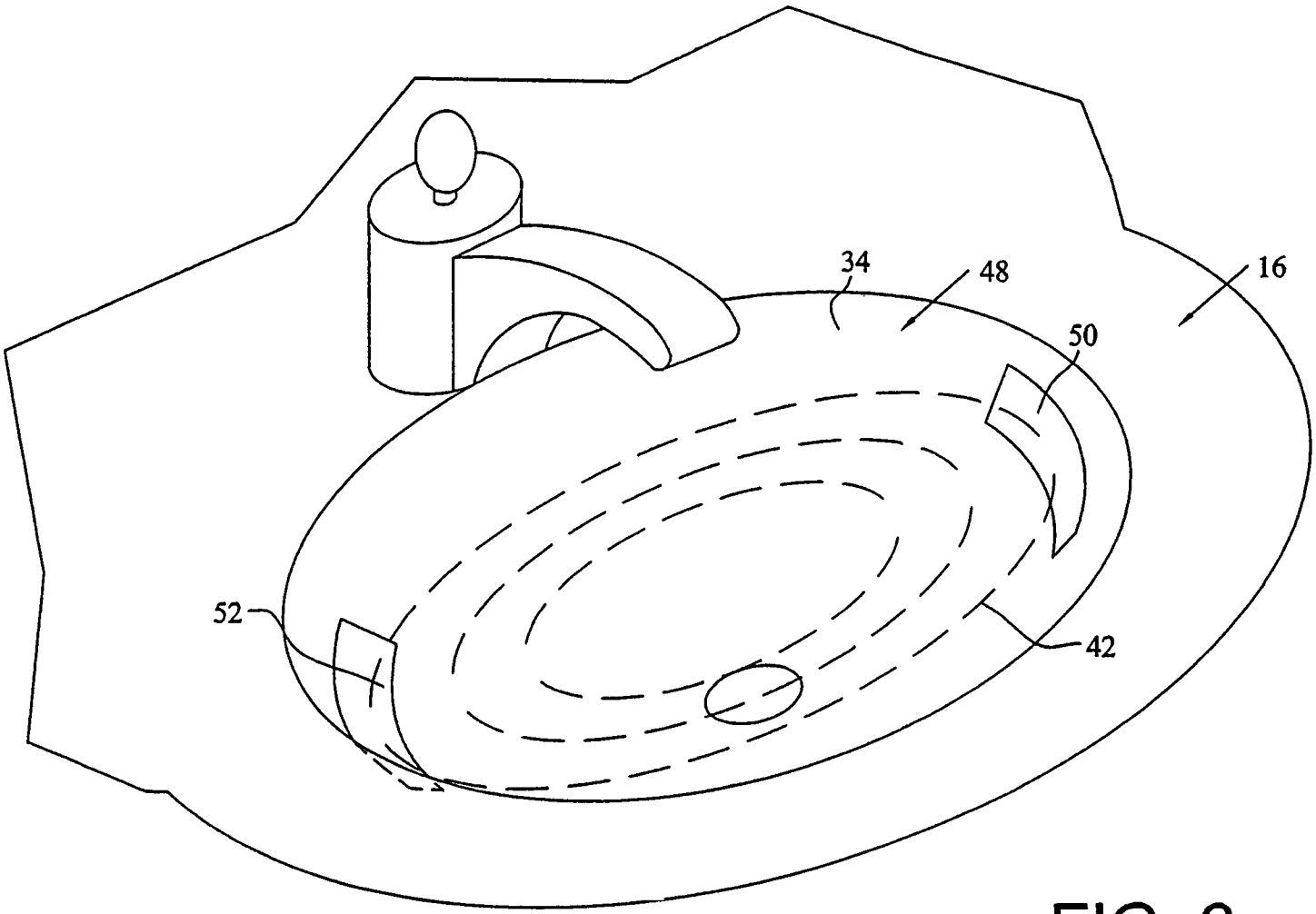
FIG. 3 is a perspective view of a fluid delivery assembly and sink basin including a sensor system.

Now referring to FIG. 3, another illustrative embodiment is substantially similar to the previous embodiment described in FIG. 2. Capacitive sensor system 48 includes, among other things, first sink basin sensor probe 50 supported in one location adjacent sink basin 16, and second sink sensor probe 52 supported in another location adjacent sink basin 16. First sink sensor probe 50 is illustratively located on one side of the bowl 34 of sink basin 16 and second sink sensor probe 52 is located on an opposite side of the bowl 34 of sink basin 16.

First and second sensor probes 50 and 52 provide a sensing field 42 therebetween under the control of controller 26 and electronic circuitry 24 as discussed above. Therefore, the sensor system 48 can detect the presence of a user's hands in the bowl 34 of sink basin 16. The sensor system 48 can also detect water level in the bowl 34 to provide for filling the bowl 34 to a predetermined level or for overfill shutoff control as discussed above.

FIG. 4 is another illustrative embodiment of a faucet 210 in which a delivery spout 60 includes both conductive material 62 and non-conductive material 64. While FIG. 4 illustratively shows a single conductive material 62 and non-conductive material 64, faucet assembly 210 may include a plurality of different conductive or non-conductive materials. Capacitive sensor system 66 includes a spout sensor probe 68 supported by the non-conductive material 64 of delivery spout 60, and a drain plug sensor probe 70. It is understood that probes 68, 70 may be located at other positions on spout 60 and sink basin 16, if desired, to shape sensing field 42.

Sensor probes 68 and 70 provide a sensing field 42 therebetween when powered by controller 26 and electronic circuitry 24 as discussed above. Therefore, the sensor system 66 detects the presence of a user's hands in the bowl 34 of sink basin 16. The sensor system 66 can also detect water level in the bowl 34 to provide for filling the bowl 34 to a predetermined level or to provide an overfill shutoff control as discussed above.

Figure 5:
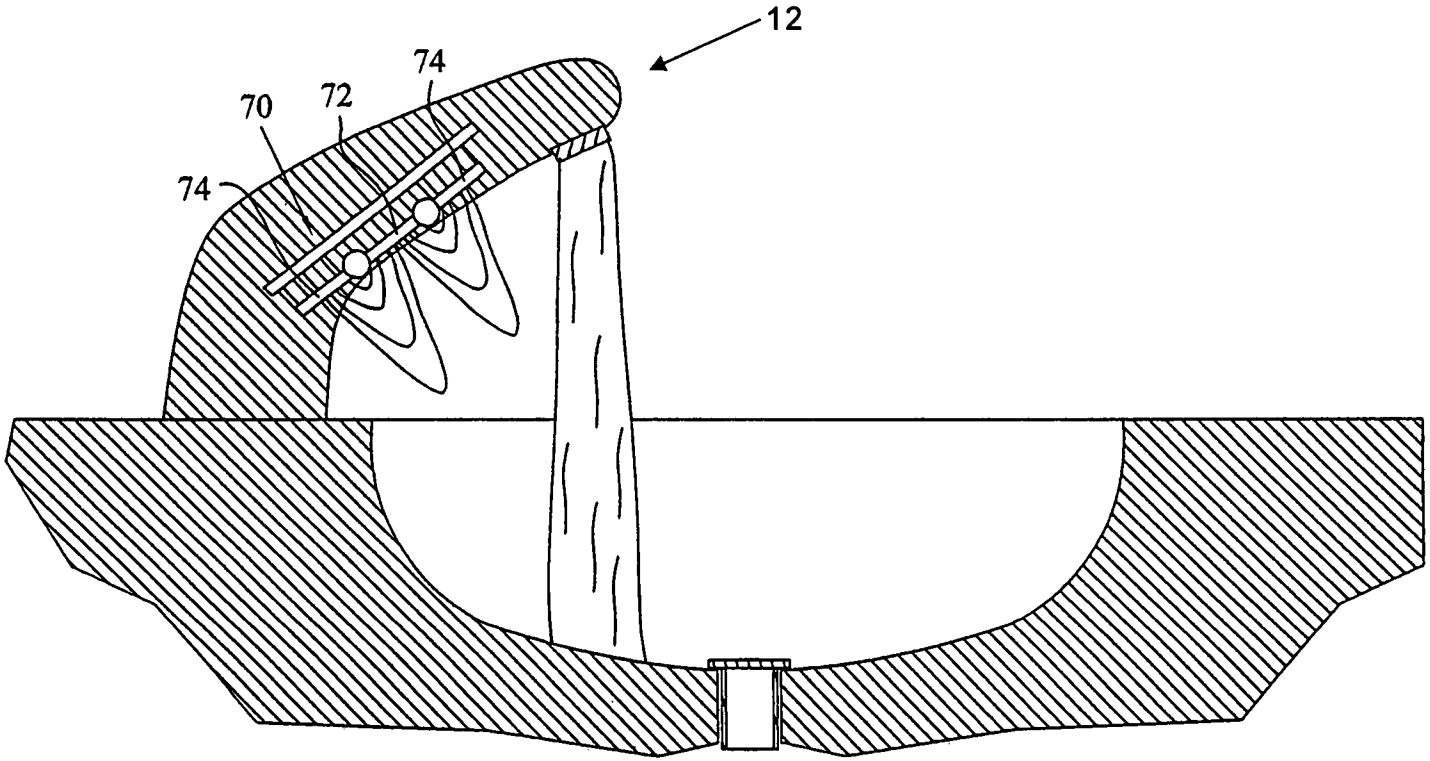
FIG. 5 is a cross-sectional view of a fluid delivery assembly and sink basin including yet another sensor system.

FIG. 5 is yet another illustrative embodiment in which capacitive sensor system 70 includes, among other things, first and second single-location sensor probes 72 and 74. Sensor probes 72 and 74 create sensing fields 75. In the illustrated embodiment, the sensor system 70 is mounted within a nonconductive spout 12 as discussed above. It is understood that the sensor system 70 may be used in conjunction with other capacitive sensors mounted in the sink basin 16 or in cabinets adjacent to sink basin as discussed herein and in U.S. Provisional Application Ser. No. 60/898,525

Figure 6:
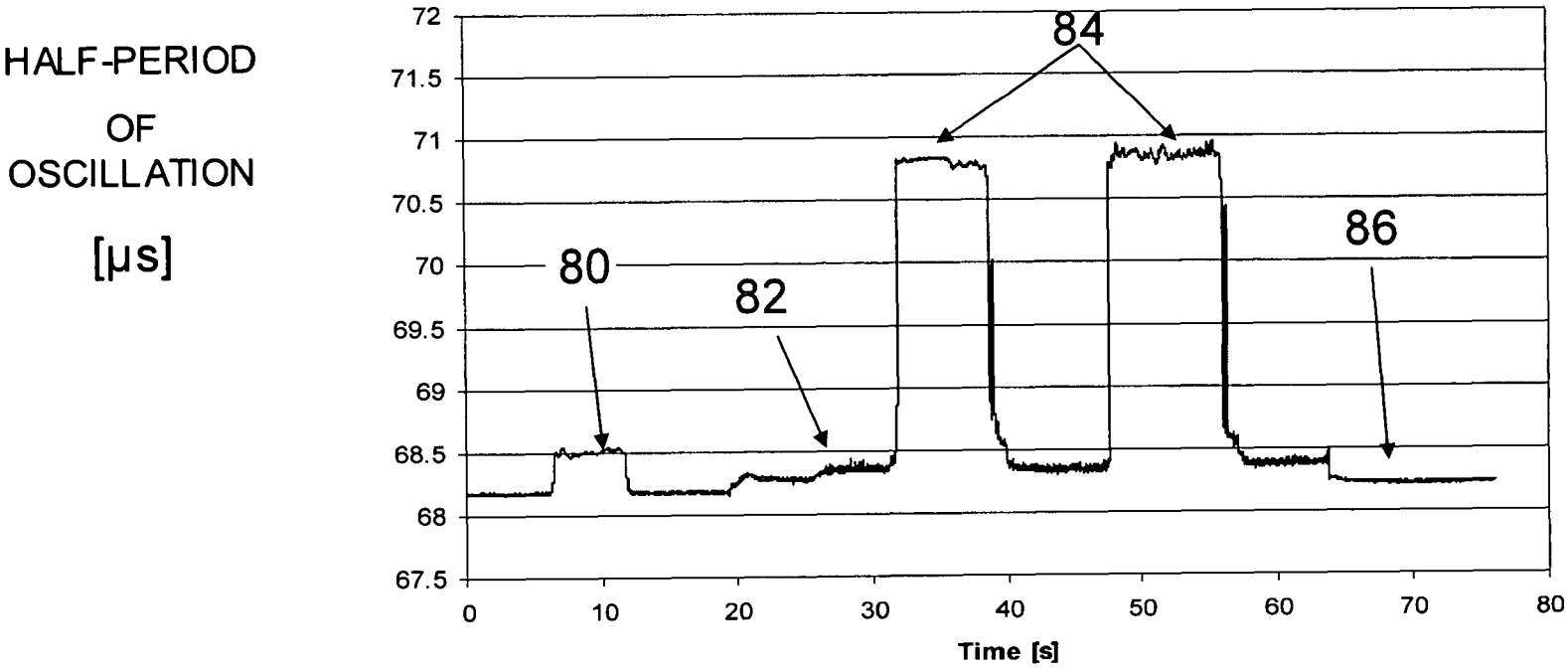
FIG. 6. is a graph illustrating an output signal from the capacitive sensor of FIG. 5.

FIG. 6 illustrates an output signal from capacitive sensor system 70 of FIG. 5. FIG. 6 illustrates that the output signal changes as hands are placed in the basin or water stream. Controller 26 detects a user's hands approaching the faucet at region 304. Region 80 illustrates the user's hands in the basin 16. Region 82 illustrates the water turned on. Regions 84 illustrate the water turned on with the user's hands in the water stream 44. Region 86 illustrates the water turned off.

Figures 7A, 7B, 7C:
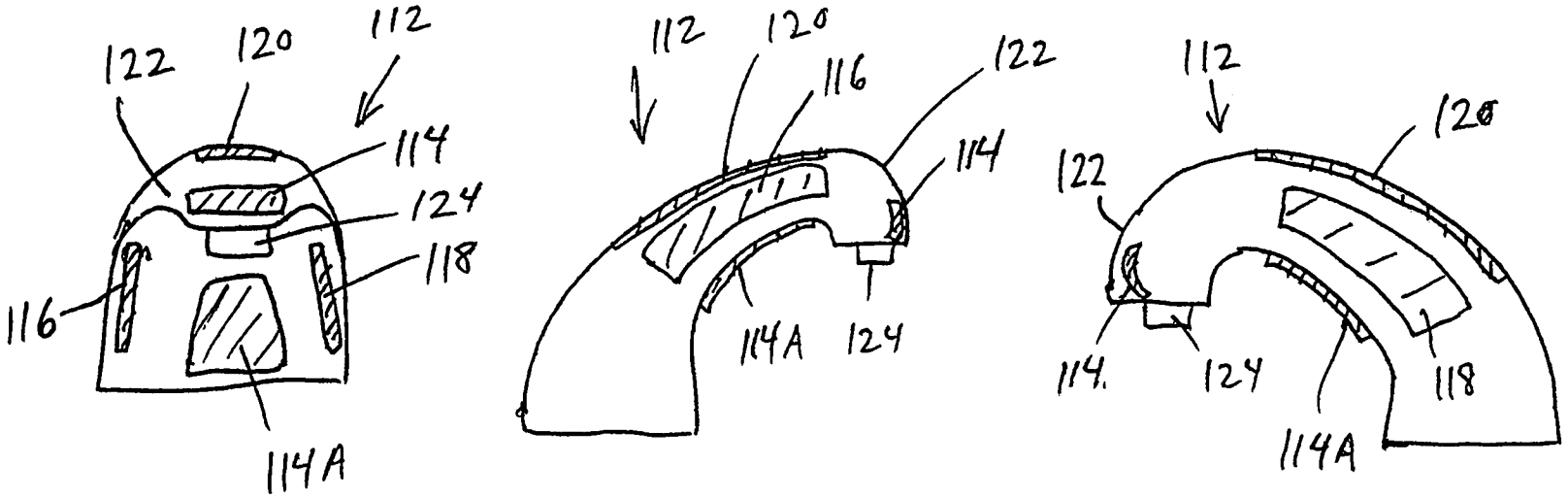
FIGS. 7A, 7B and 7C illustrate another embodiment of the present invention including multiple sensor plates in a spout of a faucet.

Another embodiment of the present invention is illustrated in FIGS. 7A-7C. In this embodiment, a spout 112 is formed from a non-conductive material as discussed herein. Spout 112 includes, for example, four separate capacitive sensor electrodes 114, 116, 118, and 120 which are either embedded in the non-conductive material of spout 112 or are located on an exterior surface of the spout 112. First sensor 114 is embedded within the front portion 122 of spout 112 adjacent water outlet 124. Second sensor 112 is embedded along a first side 126 of spout 112, and third sensor 118 is embedded along a second side 128 of spout 112. Sensor 120 extends along a top portion 130 of spout 112.

In an illustrated embodiment, sensor 114 is used as a proximity sensor, either alone or in combination with a capacitive sensor within a sink basin 16 as discussed above. If first sensor 114 detects the presence of a person adjacent the spout 112 or sink basin 16, the controller 26 activates hands-free operation using either capacitive sensing or IR sensing, or a combination thereof. If desired, sensor 114A may be used by itself, or in combination with a capacitive sensor within the sink basin 16, as a proximity sensor. Second and third sensors 118 and 116 are then used to adjust temperature or other selected parameters. For instance, the user may place his hand near sensor 116 to increase the water temperature, and the user may place his hand near sensor 118 to decrease the water temperature.

Sensor 120 is used, for example, as a tap on and off sensor. In an illustrated embodiment, when a user taps or grasps sensor 120 (or otherwise places his hand adjacent to or touching sensor 120), controller 26 provides an override of the hands-free operation to permit manual control of the faucet system 10 using manual valve handles 17 discussed above. As also discussed above, the embodiment of FIGS. 7A-7C illustratively uses non-metallic faucet materials in spout 112. Therefore, metal sensor plates 114, 116, 118 and 120 may be molded inside the spout 112. The embodiment of FIGS. 7A-7C may also be used with metal spouts 112.

The four sensing plates, 114, 116, 118 and 120 may provide sensors using several sensing techniques. In one embodiment, a multiplexing or switching technique is used to switch between each of sensing plates 114, 116, 118 and 120 in a sequential fashion at regular time intervals to selectively couple the sensors 114, 116, 118 and 120 to a timer circuit as discussed herein. In this manner, a single controller may be used to monitor all four sensors 114, 116, 118 and 120. Logic decisions controlling water flow and temperature are all made by controller 26.

Figure 8:
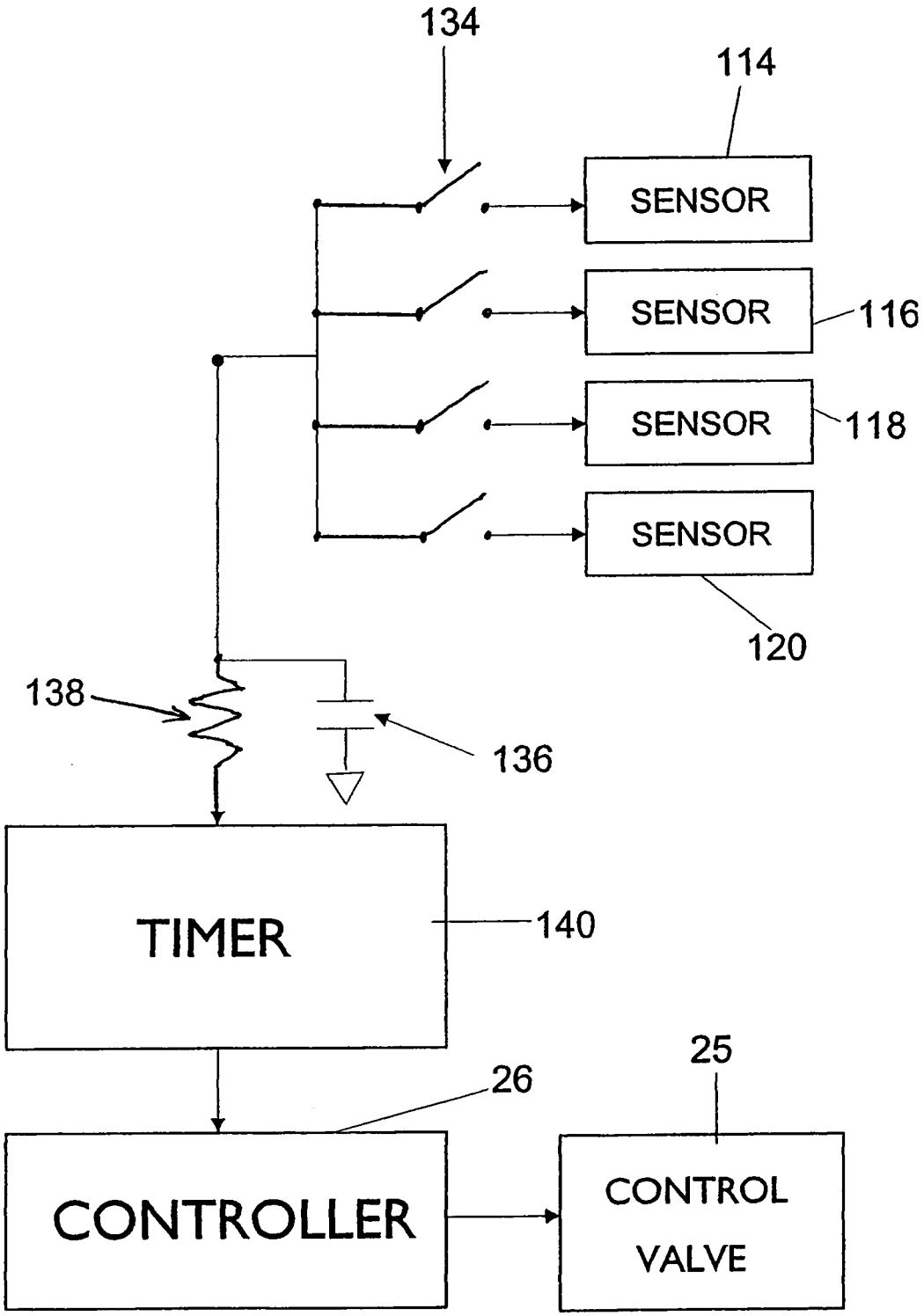
FIG. 8 illustrates a multiplexing sensor detection system for sequentially monitoring the multiple sensors of FIGS. 7A-7C.

FIG. 8 illustrates the multiplexing embodiment in which sensors 114, 116, 118 and 120 are selectively coupled by closing appropriate switch 134. When one of the switches 134 is closed, a particular sensor 114, 116, 118 and 120 is coupled through capacitor 136 to ground. The sensor 114, 116, 118 and 120 is also coupled through a resistor 138 to an input of a timer 140, such as a 555 timer. For a known value of resistor 138, the capacitance to ground may be determined by measuring a frequency of an output signal from timer 140 which is coupled to controller 26. As capacitance detected by sensors 114, 116, 118 and 120 increases, frequency of the output signal from timer 140 decreases.

Figure 9:
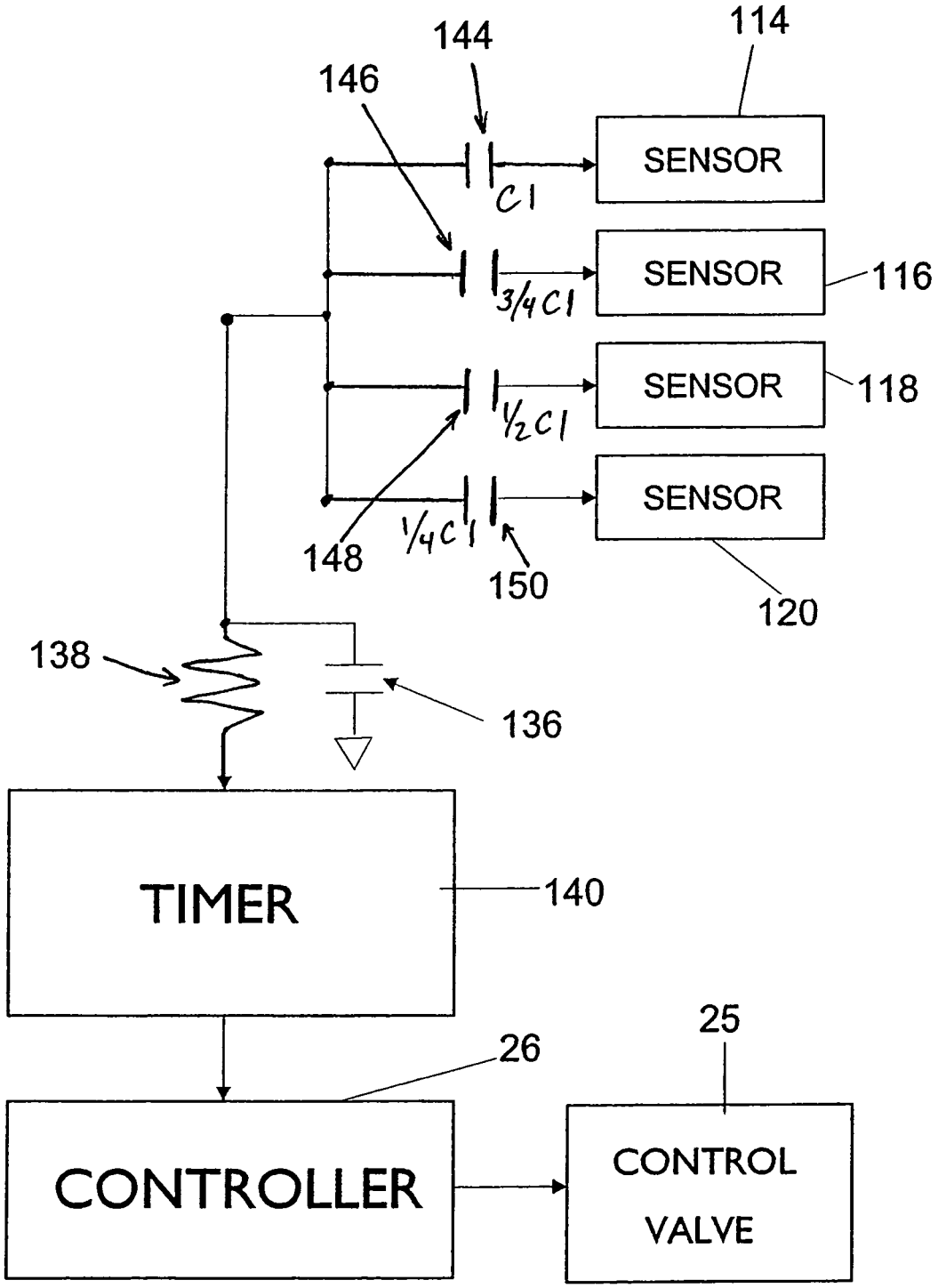
FIG. 9 illustrates a capacitive sensor detection system for simultaneously monitoring multiple sensors of FIGS. 7A-7C.

In another embodiment, all four sensors 114, 116, 118 and 120 may be simultaneously monitored as illustrated in FIG. 9.

In this embodiment, sensor 114 is coupled through a capacitor 144 and through capacitor 136 to ground. Capacitor 144 is also coupled through resistor 138 to an input of timer 140. Sensor 116 is coupled through capacitor 146 to timer 140 in a similar manner. Likewise, sensor 118 is coupled through capacitor 148 to timer 140, and sensor 120 is coupled through capacitor 150 to timer 140. Illustratively, capacitor 144 has a selected value C1. Capacitor 146 has a value (¾ C1) three-fourths the value of capacitor 144. Capacitor 148 has a value (½ C1) one-half the value of capacitor 144. Capacitor 150 has a value (¼ C1) one-fourth the value of capacitor 144. The different capacitance values of capacitors 144, 146, 148 and 150 produce different amplitudes of signal change when the dielectrics adjacent sensors 114, 116, 118 and 120, respectively, change. Therefore, controller 26 may use these different amplitudes to determine which sensor 114, 116, 118 or 120 has been touched.

Figure 10:
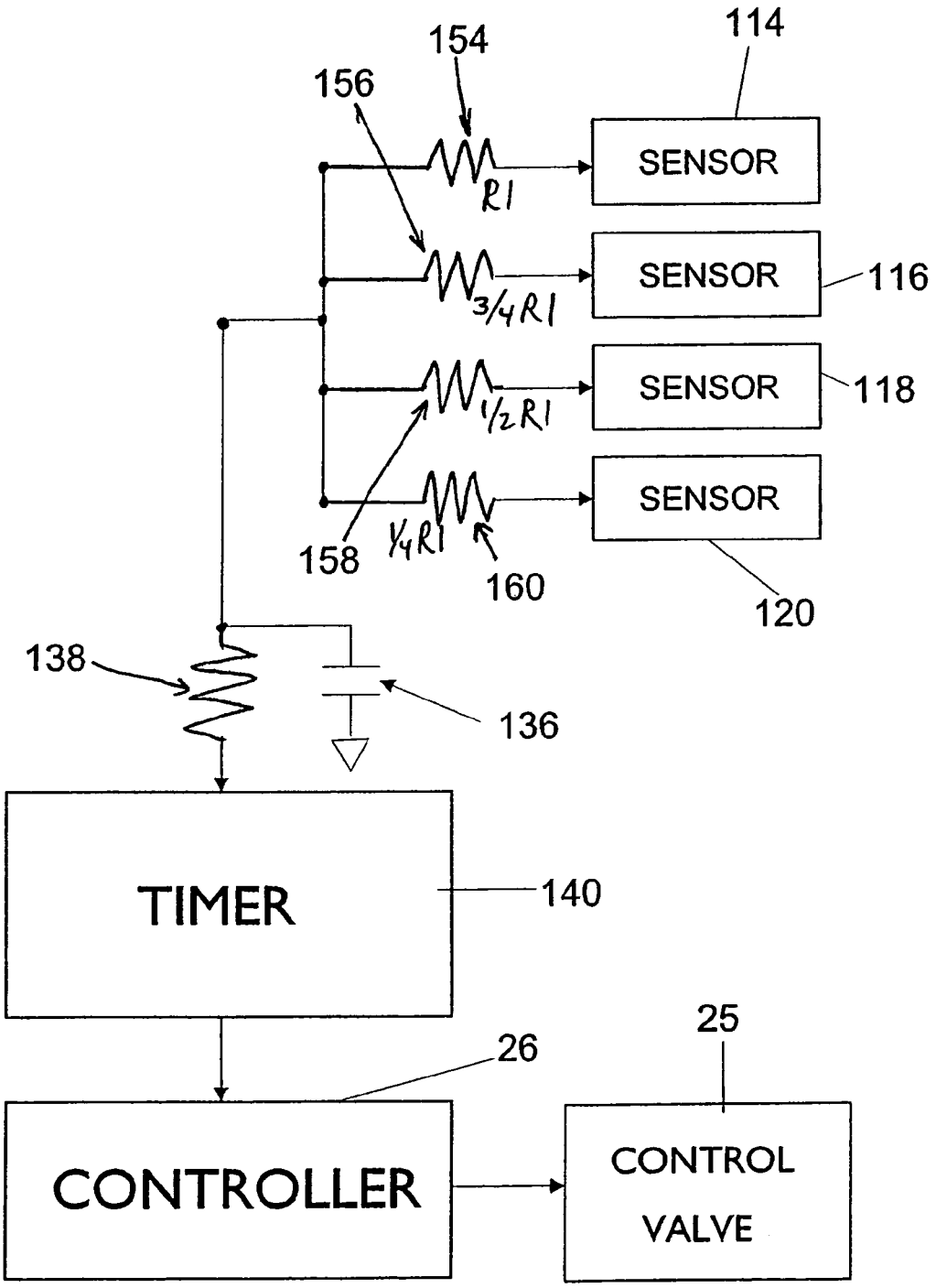
FIG. 10 illustrates a resistive sensor detection system for simultaneously monitoring multiple sensors of FIGS. 7A-7C.

FIG. 10 illustrates an embodiment similar to FIG. 9 in which resistors are used instead of capacitors. In the FIG. 10 embodiment, all four sensors 114, 116, 118 and 120 are simultaneously monitored. Sensor 114 is coupled through a resistor 154 and through capacitor 136 to ground. Resistor 144 is also coupled through resistor 138 to an input of timer 140. Sensor 116 is coupled through resistor 156 to timer 140 in a similar manner. Likewise, sensor 118 is coupled through resistor 158 to timer 140, and sensor 120 is coupled through resistor 160 to timer 140. Illustratively, resistor 154 has a selected value R1. Resistor 156 has a value (¾ R1) three-fourths the value of resistor 154. Resistor 158 has a value (½ R1) one-half the value of resistor 154. Resistor 160 has a value (¼ R1) one-fourth the value of resistor 154. The different values of resistors 144, 146, 148 and 150 produce different amplitudes of signal change when the dielectrics adjacent sensors 114, 116, 118 and 120, respectively, change. Therefore, controller 26 may use these different amplitudes to determine which sensor 114, 116, 118 or 120 has been touched.

Figure 11:
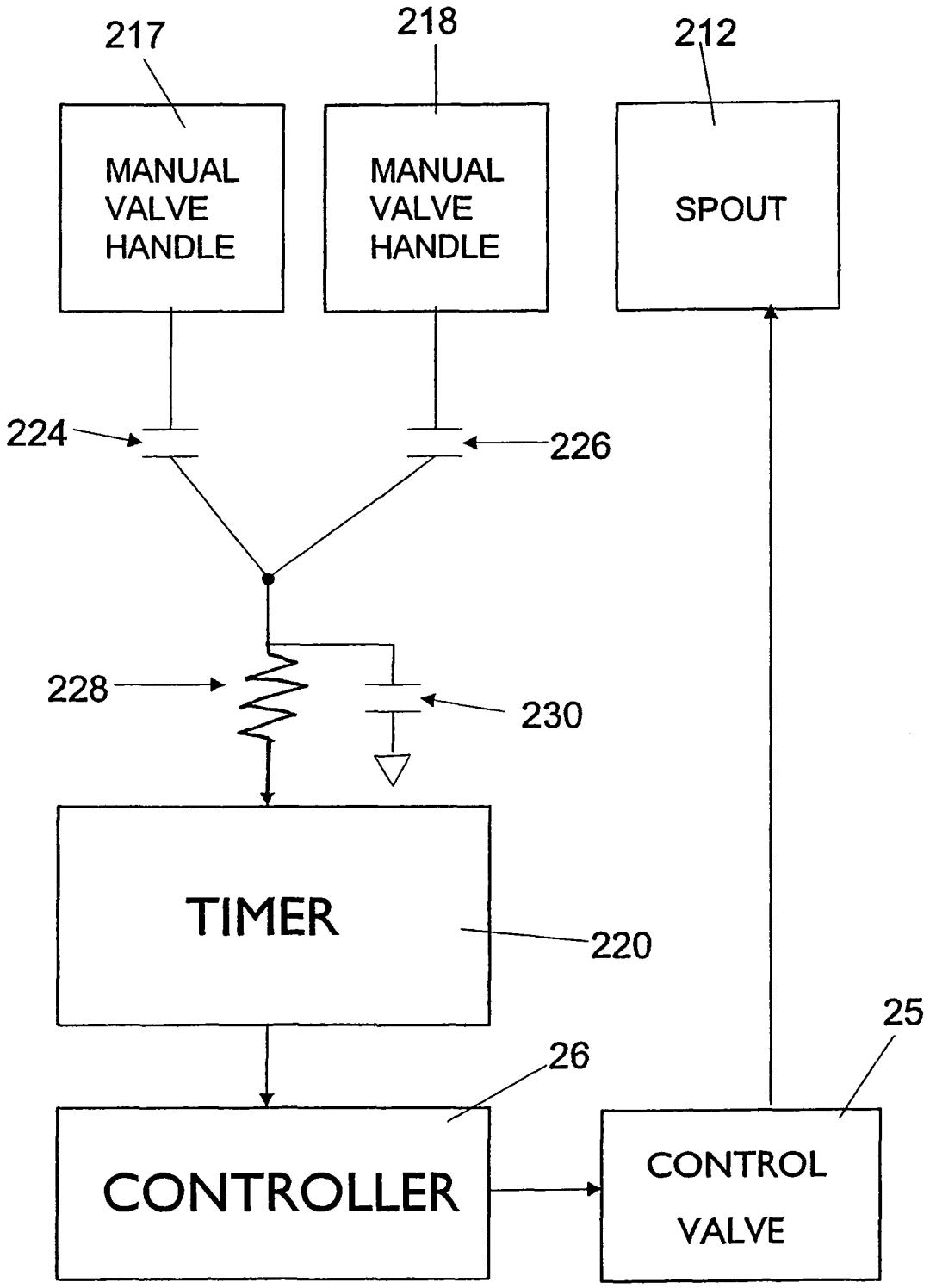
FIG. 11 illustrates a capacitive sensor detection system for monitoring touching of manual valve handles.

Another embodiment of the present invention is illustrated in FIG. 11. In this embodiment, a spout 212 is provided. In at least one embodiment, water flow to spout 212 is controlled by manual valve handles 217 and 218. Valve handles 217 and 218 are coupled through capacitors 224 and 226, respectively, to the input of timer 220 through a resistor 228. Capacitors 224 and 226 are also coupled to ground through capacitor 230. An illustrated embodiment of capacitor 226 has a selected value (C1) for capacitor 226. Capacitor 224 has a value (1/2 C1) equal to one-half of the value of capacitor 226. This permits controller 26 to determine which of the handles 217, 218 has been touched by the user since different amplitude signals will be created due to the differing capacitances 224, 226.

It is understood that additional or fewer sensors may be monitored in the ways shown in FIGS. 8-11. Therefore, the embodiments are not limited to monitoring four sensors as shown.

Figure 12:
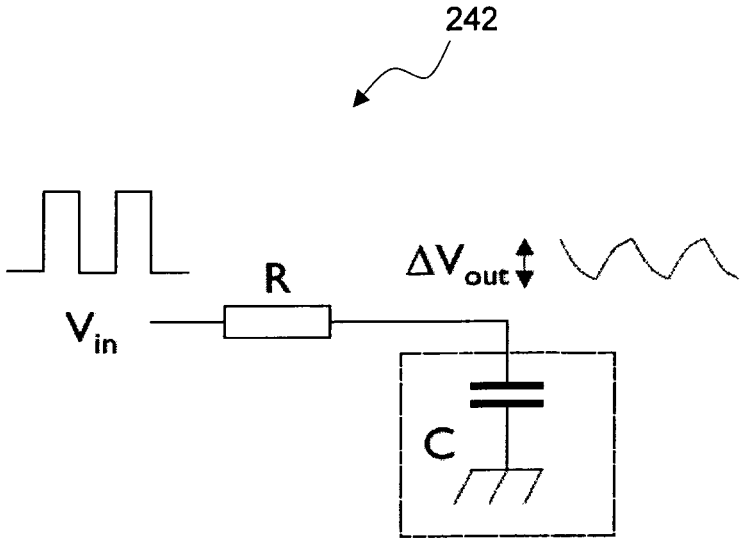
FIG. 12 is a diagrammatical view of a oscillator capacitive sensor.
Figure 13:
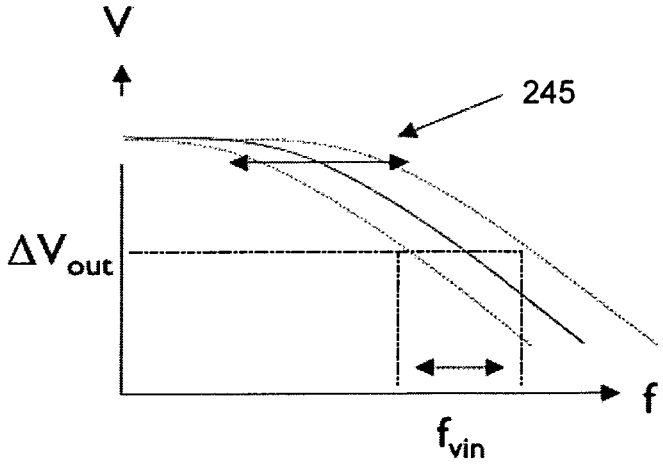
FIG. 13 is a graph illustrating changes in a frequency of an output signal of the oscillator with change in capacitance.

As discussed above, in illustrated embodiments of the present invention, capacitive sensors 41 are placed on an exterior wall of the basin or embedded into the wall of the sink basin 16. Each sensor 41 may include an electrode 246 which is connected to a capacitive sensor such as a timer 244 shown in FIG. 14. When a user's hands are placed into the sink basin 16, the capacitance to earth ground detected by sensor 41 increases. Controller 26 receives the output signal and determines whether to turn on or off the water based on changes in capacitance to earth ground. In one embodiment, a timer circuit, such as a 555 timer chip 244 is used as the capacitive sensor 41. Resistance values are selected to oscillate with typical capacitance to earth ground from a sink basin 16. FIG. 12 illustrates a relaxation oscillator sensing circuit 242 which drives current into an RC network. The time taken to charge a fixed voltage is related to the RC constant. A grounded object introduced between the electrodes draws an additional flux, thereby increasing capacitance. The frequency of the output signal changes with changes in capacitance as shown in FIG. 13. As illustrated at location 245 in FIG. 13, the "knee" of RC roll-off moves with capacitance charges. Timer 244 may be a IMC 7555 CBAZ chip. It is understood that other types of capacitive sensors may also be used in accordance with the present invention, examples of which are discussed herein.

Figure 14:
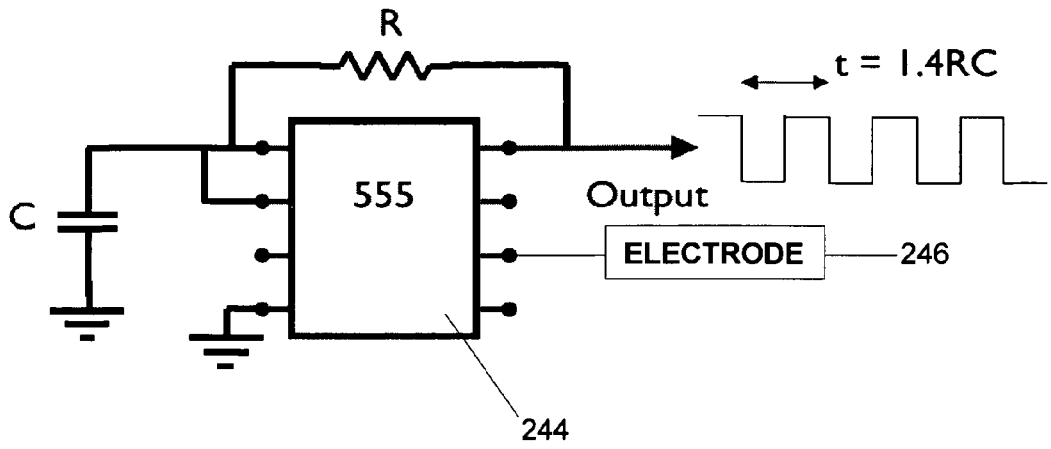
FIG. 14 is an illustrative timer circuit used to provide the oscillator in one illustrated embodiment of the present invention.

An illustrated sensor circuit is shown in FIG. 14. In FIG. 14, a 555 timer 244 is used as a relaxation oscillator. Capacitance is provided by the capacitance to ground of a sense electrode 246 which is coupled to various locations in the sink basin as discussed herein. For a known R value, the capacitance to ground may be determined by measuring the period of the output wave (t) illustrated in FIG. 14. In other words, the output of timer 244 has a frequency that changes as capacitance to ground changes. The higher the capacitance, the lower the frequency of the output signal (t). The timer 244 (or other capacitive sensing element) is connected to electrically conductive elements such as electrode 246 either surrounding the sink basin 16 or embedded within the sink basin 16. In other illustrated embodiments, the conductive elements may be located in a counter top or cabinet adjacent the sink basin 16.

A baseline frequency for the sensor 41 is first determined with no hands in the sink. Shifts in the frequency of the output signal (t) indicate that a user's hands are located in the sink basin 16 and a decision is made by controller 26 to activate water flow by controlling the actuator driven valve 25. In an illustrated embodiment, the activator driven valve 25 is an electro-magnetic valve.

The degree of frequency shift is also used to determine the location of a user's hands within the basin 16. The closer the hands are to the basin 16, the lower the frequency of the output signal (t).

Figure 15:
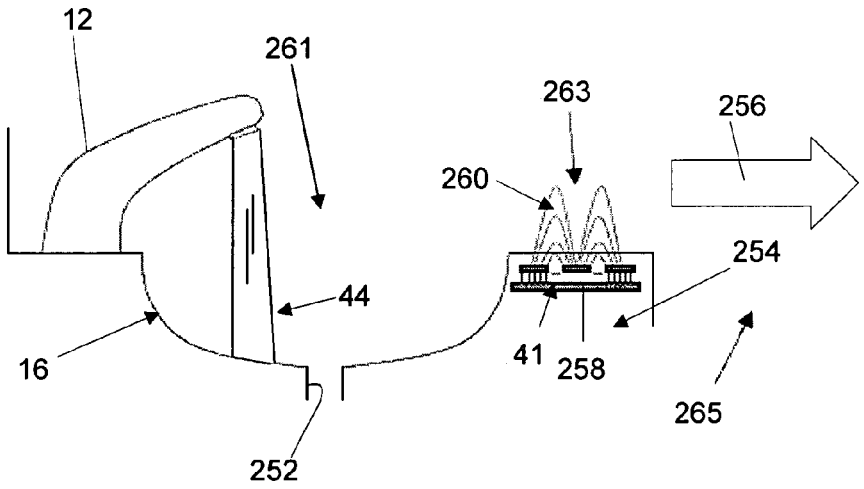
FIG. 15 illustrates a capacitive sensor located in a front portion of the sink basin or sink cabinet.
Figure 16:
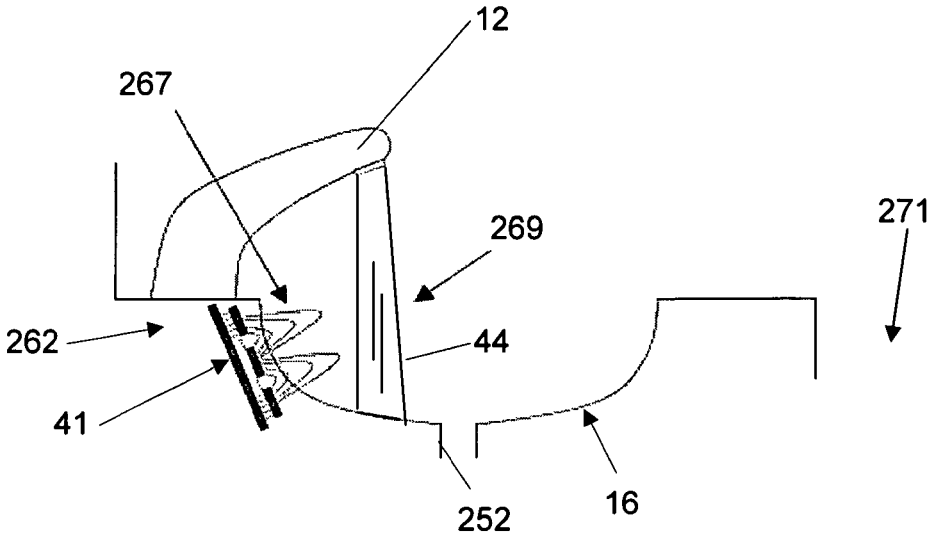
FIG. 16 is a diagrammatical view illustrating a capacitance sensor at the rear of the basin.
Figure 17:
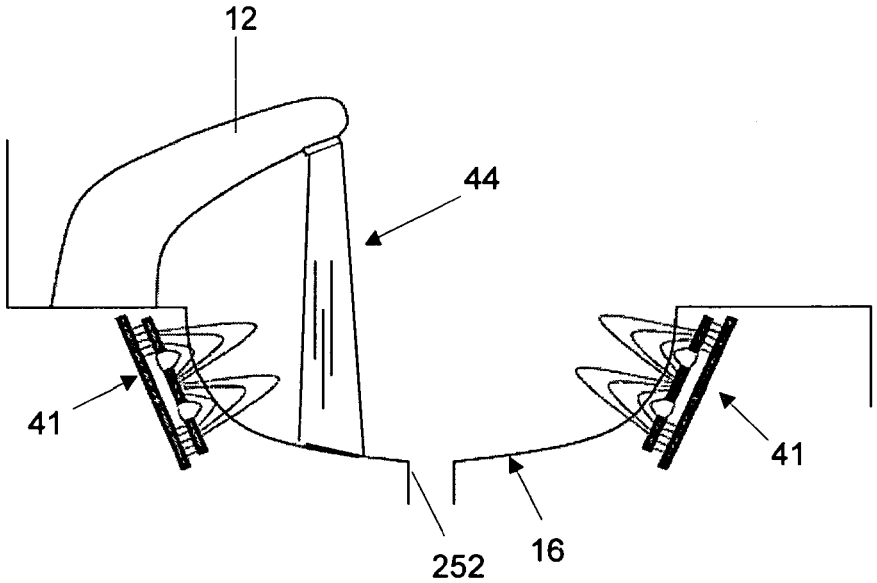
FIG. 17 illustrates a capacitive electrode ring surrounding the basin.

FIGS. 15-17 are further illustrated examples of placement of capacitive sensors 41 adjacent the sink basin 16. FIGS. 15-17 illustrate a stream of water 44 flowing into the sink basin 16 from spout 12. A drain hole 252 is sealed with a drain plug (36,70 discussed above). In FIG. 15, the capacitive sensor 41 is located in front of the basin 16 illustratively in a sink cabinet 254 or other structure. Sensor 41 in FIG. 15 is not sensitive to water stream 44 at location 261. Sensor(s) 41 at the front of basin 16 detect a user's arms reaching across sensor(s) 41 at location 263. The sensor(s) 41 of FIG. 15 may also be oriented facing away from the sink basin 16 in the direction of arrow 256 to detect a user approaching the sink basin 16 at location 265.

Illustratively, capacitive sensor(s) 41 includes a shield 258 which directs a sensing zone 260 in a particular known direction. As the size of the sensing plates is increased, the distance which can be sensed by capacitive sensors 41 also increases. In the embodiment of FIG. 15, the controller 26 detects a user approaching the sink basin 16 at location 265 and may turn on the water stream 44 by actuating valve 25 before the user places his or her hands into the sink basin 16. This may reduce splashing of water out of the sink basin 16. Controller 26 can automatically shut off the water flow through spout 12 when the user walks away from the sink basin 16 as detected by capacitive sensor(s) 41 within the cabinet or other structure adjacent sink basin 16.

FIG. 16 illustrates capacitive sensors 41 located adjacent a rear portion 262 of sink basin 16. The capacitive sensors 41 in this location detect the user's hands behind the water stream 44 at location 267. Sensor 41 in the FIG. 16 is somewhat sensitive to water stream 44 at location 269, but this embodiment is not sensitive to user approaching the sink basin 16 at location 271.

FIG. 17 illustrates an electrode ring capacitive sensor 41 surrounding the basin 16. The capacitance caused by the user's hands in basin 16 is greater than from the water stream 44. Therefore, controller 26 can differentiate between the water stream 44 and the user's hands within sink basin 16. In addition, the capacitance caused by the user's hands inside the basin 16 is greater than the capacitance caused by the user's hands outside the basin 16. If desired, separate discrete sensors 41 can be placed around the sink basin 16 at locations similar to those shown in FIG. 17, but without being a continuous ring. For instance, if one capacitive sensor 41 is located in a front portion of basin 16 and two capacitive sensors 41 are spaced apart at a rear portion 262 of basin 16, controller 26 can triangulate the location of the user's hands within the basin 16 using outputs from the three discrete sensors 41. Controller 26 may sample signals from a plurality of sensors 41 individually to determine where the user's hands are located relative to the basin 16.

Figure 18:
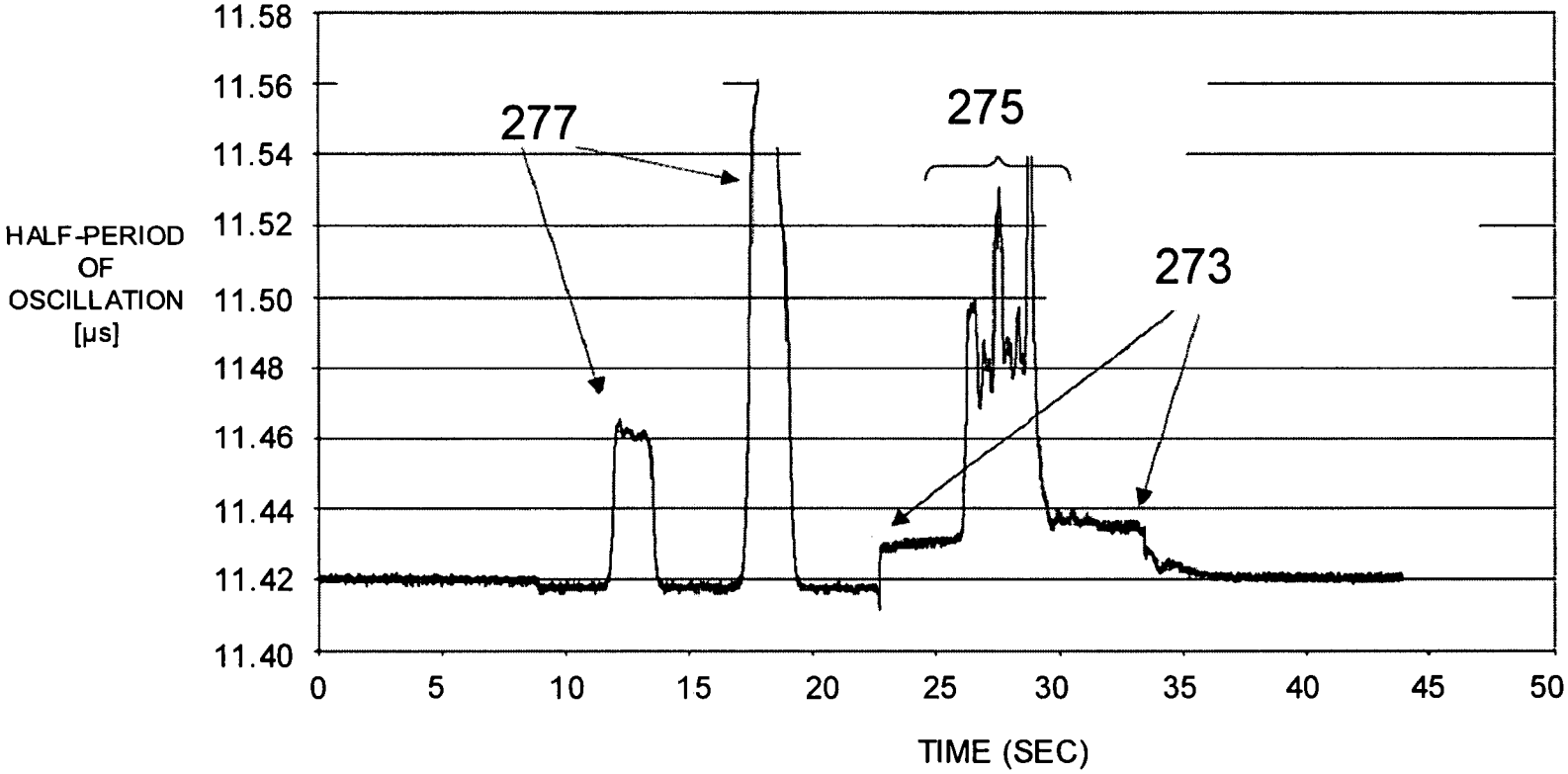
FIG. 18 is an illustrative output signal showing change in the frequency of the output signal depending upon the detection of hands and water in the basin.

FIG. 18 is a graph of the output signal of the capacitive sensor 41 in the embodiment shown in FIG. 16. The user approaching the basin 16 is not detected by the sensor 41. However, the sensor 41 detects hands within the basin at locations 277 and turning the water on and off as shown in FIG. 18 which is a graph of the half period of oscillation is shown versus a time at location 273. Region 275 illustrates the water stream 44 on with the user's hands in the water stream 44.

Figure 19:
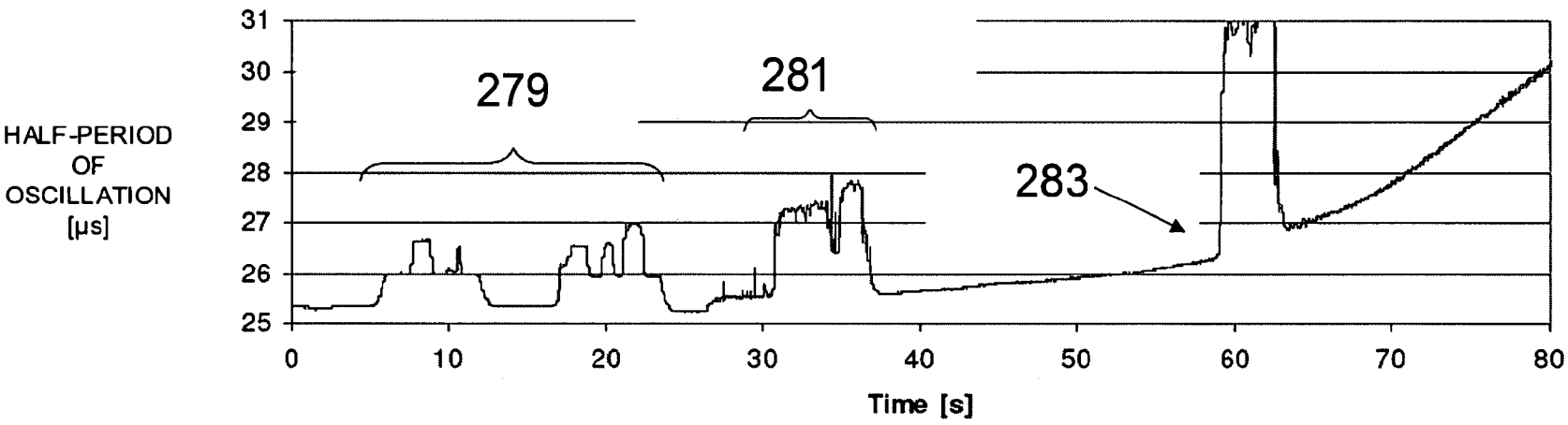
FIG. 19 illustrates an output signal from the capacitive sensor surrounding the basin in the embodiment shown in FIG. 17.

FIG. 19 illustrates the output signal from the electrode ring around the basin 16 shown in FIG. 17. The sensor of FIG. 17 provides suitable signal to noise ratios to detect hands within the basin 16 as illustrated in region 279. However, the user standing in front of the basin 16 gives a response of about 50% of the response detected when the user's hands are in the basin 16 as shown in FIG. 19. Region 281 illustrates the water stream 44 on with the user's hands in the water stream 44. The filling of the basin 16 creates a large signal output as shown at location 283 in FIG. 19. As discussed above, by providing separate sensors 41 spaced apart around the circumference of basin 16, controller 26 may provide a better indication of where the user's hands are relative to the sink basin 16.

Figure 20:
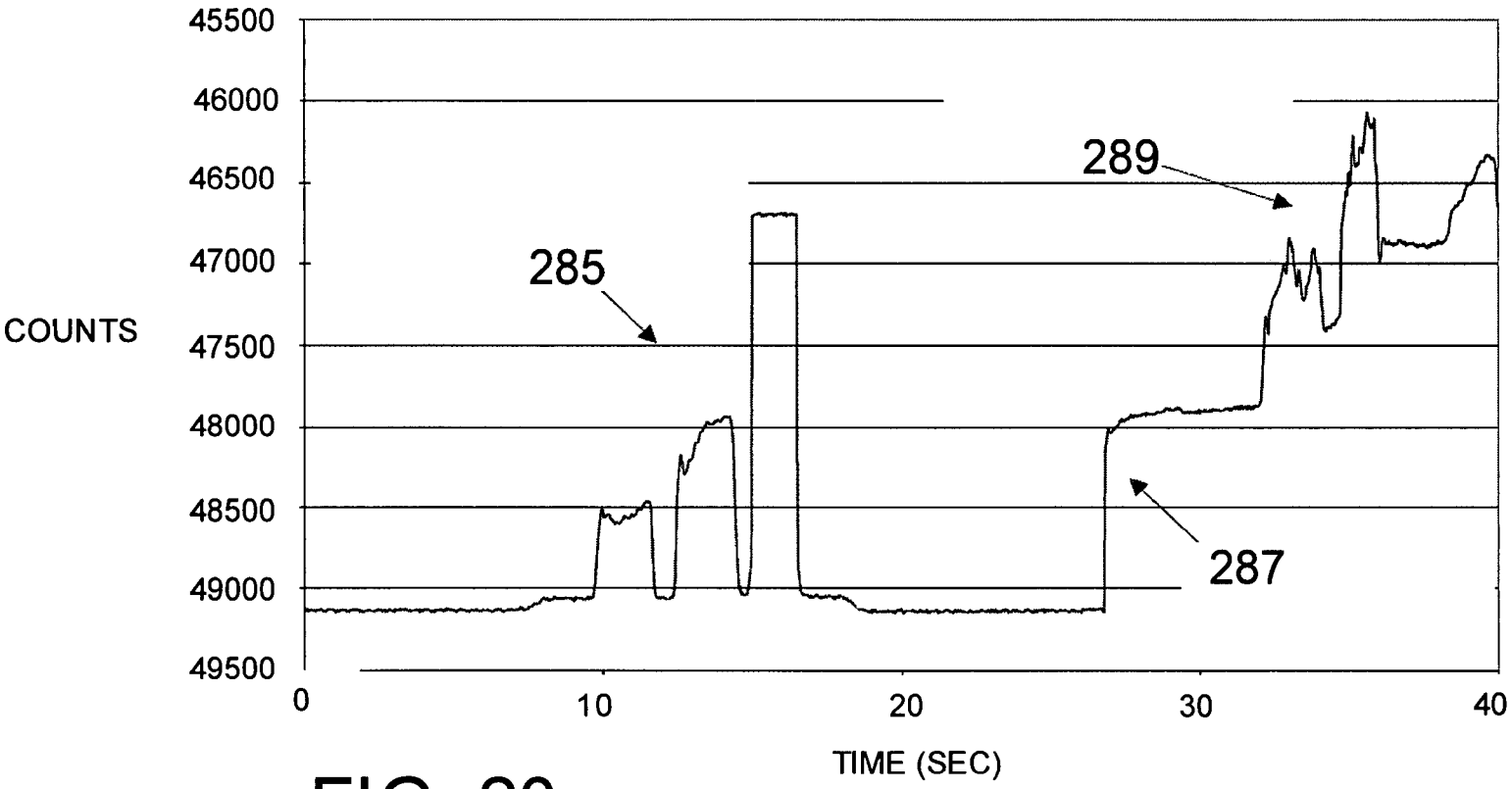
FIG. 20 is an output signal of another embodiment of the present invention using a different type of capacitance sensor.

FIG. 20 illustrates another embodiment in which an Analog Devices' AD7142 capacitive-to-digital converter is used as the capacitive sensor 41. FIG. 20 shows detection of the user's hands in and out of the basin 16 as illustrated at region 285, the water being turned on at location 287, and the user's hands in the water stream 44 at location 289.

If the water stream 44 is suddenly connected to earth ground by contacting an earth grounded drain plug located the drain hole 252, the sensors 41 will detect a sudden change in the output signal. By ensuring that the spout 12 is well grounded and in good contact with the water, the effect of the water stream 44 contacting the drain plug is minimized. When water stream 44 is contacting the drain plug, the user's hands within the water stream decrease the capacitance detected by sensors 41.

Figure 21:
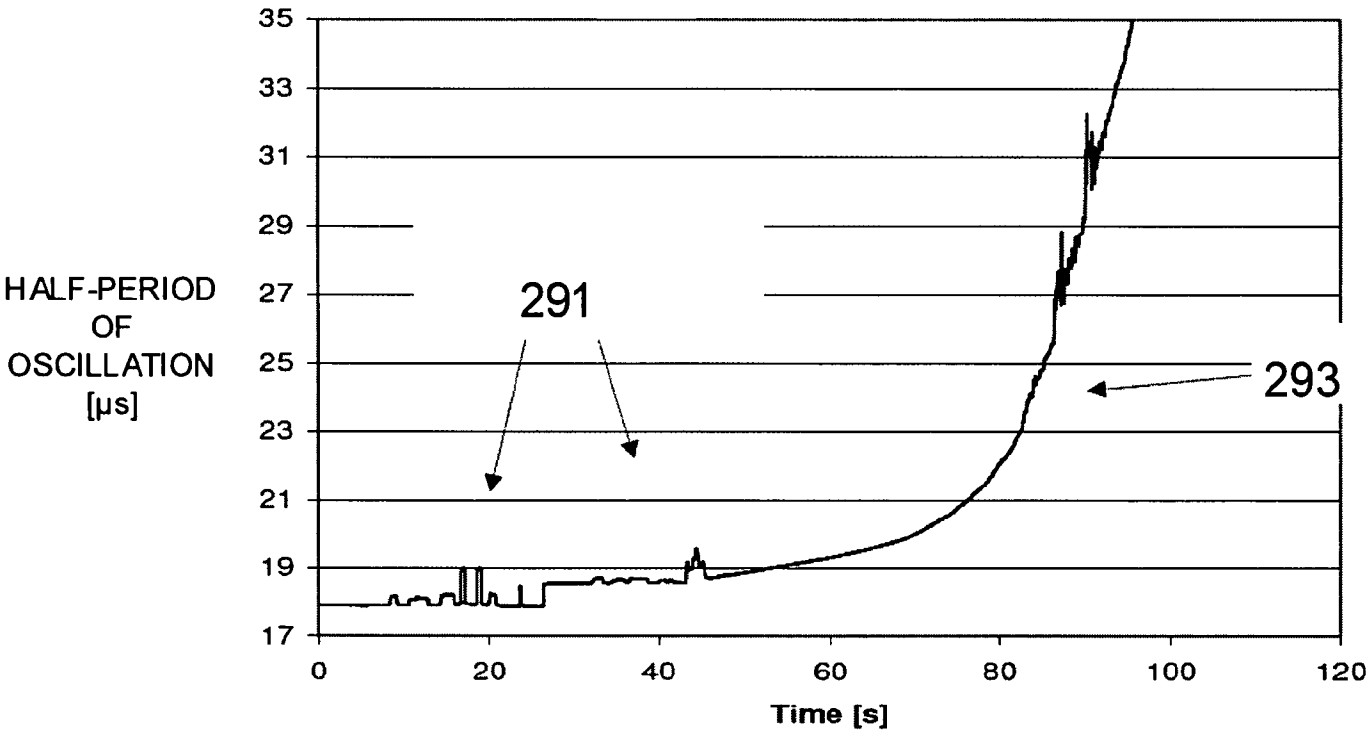
FIG. 21 illustrates the output signal as the basin fills with water.

FIG. 21 illustrates detection of the user's hands in and out of the water at locations 291 and the basin 16 filling with water at location 293. Therefore, controller 26 may be used to shut off the water flow from spout 12 when the basin 16 is filled to predetermined level. In addition, the user can activate a "fill the basin" function in which the controller 26 turns on the faucet and fills the basin 16 to the predetermined level without the user having to stand with her or her hands in the basin 16 for the entire fill time.

By taking capacitive measurements at sampling intervals using sensor probes on the spout 12 or sink basin 16 as discussed herein, the microprocessor based system of the present invention may be programmed with software to make intelligent decisions about the faucet environment. Information discerned using the software includes hand proximity, hands in the water stream, water in the sink bowl, a water bridge to a deck, and water flowing, for example. In addition, the software can combine the information determined from the capacitance measurements with information regarding the state of water flow (such as on or off) to make better decisions regarding when and when not to make adjustments to the activation and deactivation thresholds. By examining the stability of capacitance readings during a water flowing state, the controller 26 can determine if hands are in or out of the water stream. By also looking at the stability of the readings, controller 26 can determine whether a water bridge from the faucet to the deck has occurred. Controller 26 may automatically adjust the activation/deactivation thresholds to compensate for this condition. By looking at the capacitance measurement rate of change, controller 26 may determine the approach of hands into the basin 16 as compared to a slow change in the environment. Illustratively, turn on activation thresholds are adjusted when the water flow is off. Turn off deactivation thresholds are typically adjusted when the water flow is on and measurements are stable indicating a water bridge condition.

Figure 22:
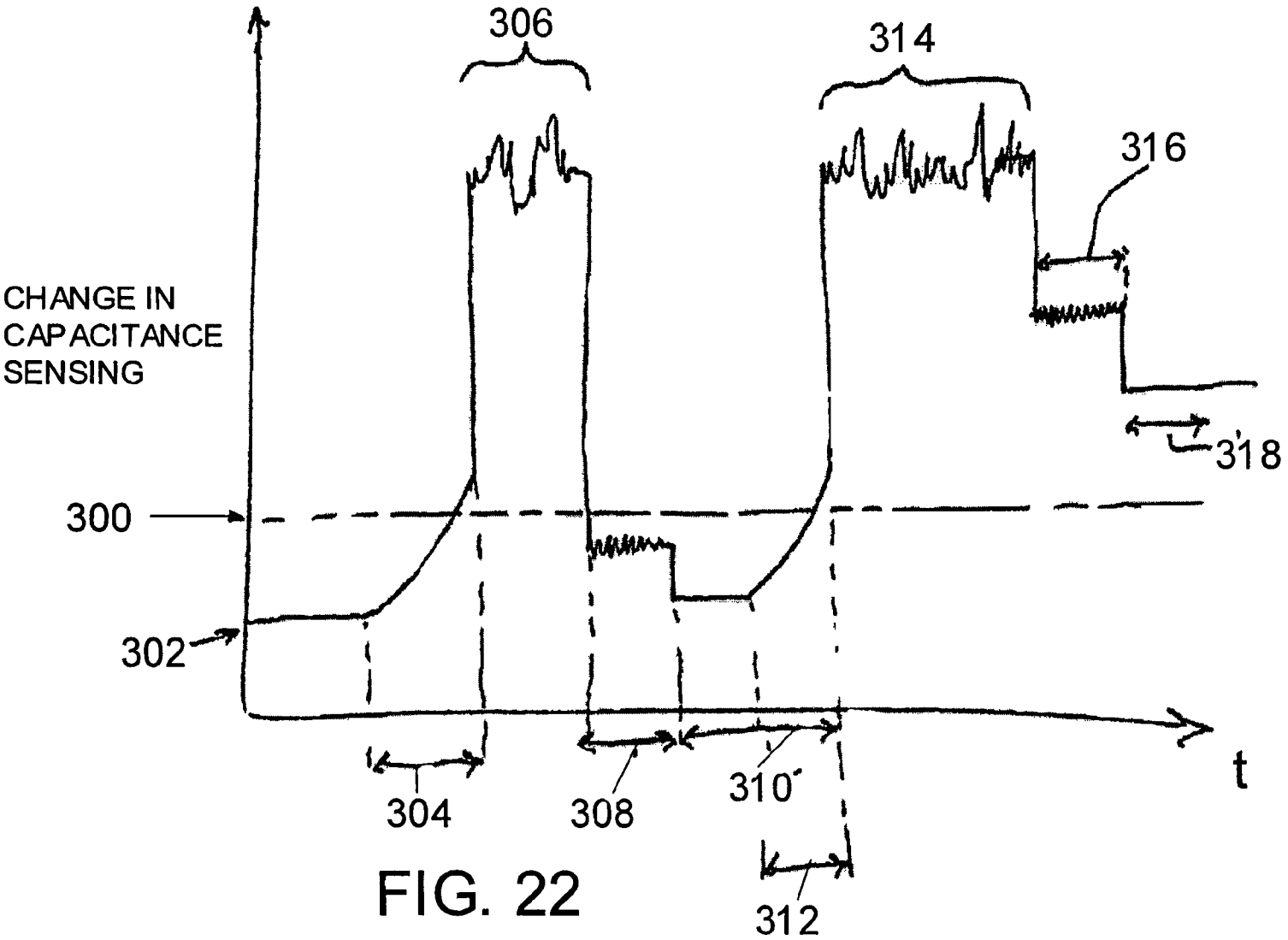
FIG. 22 illustrates an output signal from another embodiment of capacitive sensor.

FIG. 22 illustrates various conditions detected by controller 26 by detecting change in capacitance over time. The activation threshold is illustrated at location 300. When the capacitance reaches this activation threshold, controller 26 illustratively turns on water flow. A quiescent capacitive state during a period of inactivity is illustrated by capacitance level 302. Controller 26 detects a user's hands approaching the faucet at region 304. Region 306 illustrates the user's hands in the water stream 44 with the water turned on. Region 308 illustrates the water turned on with the user's hands out of the stream 44. Region 310 illustrates the water turned off. Region 312 illustrates the user's hands again approaching the faucet with the water still off. Region 314 illustrates the user's hands in the water stream with the water on. Region 316 illustrates the water on with a water bridge to the countertop adjacent the sink basin 16. Region 318 illustrates a water bridge to the countertop with the water turned off.

In another embodiment of the present invention, the capacitive sensors 41 work in combination with an infrared (IR) sensor 33 located on or adjacent the spout 12 to control water flow as illustrated in FIG. 1. For instance, if the user's hands move out of the IR sensor 33 location, but are still in the sink basin 16, the controller 26 may continue to cause water flow even though the output from IR sensor 33 does not detect the user's hands. This may reduce pulsing on and off of water which sometimes occurs when only an IR sensor 33 is used for a hands free mode of operation. Details of additional sensors which may be used in combination with the capacitive sensors 41 on the basin 16 as well as different modes of operation are described in U.S. Provisional Application No. 60/794,229 which is expressly incorporated by reference herein.

An illustrated capacitive sensor 29 which may be incorporated into the spout 12 of the faucet assembly is taught by U.S. Pat. No. 6,962,168, the disclosure of which is expressly incorporated by reference herein. In certain illustrative embodiments, the same mode-selector can be used to return the faucet assembly from hands-free mode to manual mode. In certain of these illustrative embodiments, as detailed herein, a touch-sensor 31 is also incorporated into the handle(s) 17. In such illustrative embodiments, the two touch controls can either operate independently (i.e. mode can be changed by touching either one of the touch controls), or together, so that the mode is changed only when both touch controls are simultaneously touched.

In certain alternative embodiments, the controller shifts between a manual mode in which faucet handles control manual valves in a conventional manner to a hands-free mode. In this embodiment, capacitive sensors in the spout and handles can be used to determine when a user taps or grabs the spout or handles as described in U.S. application Ser. No. 11/641,574; U.S. application Ser. No. 10/755,581; U.S. application Ser. No. 11/325,128; U.S. Provisional Application Ser. No. 60/662,107, the disclosures of which are all expressly incorporated herein by reference. Other embodiments of capacitive sensors which may be used in spout 12 are illustrated in U.S. Provisional Application Ser. No. 60/898,525, the disclosure of which is expressly incorporated herein by reference.

It is understood that other types of sensors may be used in accordance with the presence invention for instance, QPROX™ sensors from Quantum Research Group, Oblamatik sensors, or other types of capacitive sensors from other manufacturers such as Analog Devices AD7142 chip. In one illustrated embodiment, capacitive sensors such as a PSoC CapSense controller available from Cypress Semiconductor Corporation may be used as capacitance sensors described herein. The Cypress sensor illustratively includes a microprocessor with programmable inputs and outputs that can be configured as sensors. This allows the capacitance sensors to be included in the same electrical or component or circuit board as the microprocessor, making the sensor cost-effective and low power. The relaxation oscillator finds a natural frequency of the faucet and sensors probes. As objects containing capacitive properties approach the faucet (such as human hands), natural frequency of the oscillator changes based on total capacitance sensed by the circuit. At a given threshold level, a valve 25 is actuated to turn on the water as discussed herein. When the user's hands are removed, the water is turned off by shutting off valve 25. An example of the Cypress capacitance sensor using relaxation oscillators is described in U.S. Pat. No. 7,307,485, which is expressly incorporated herein by reference.

As discussed above, various combinations of capacitive proximity sensors and/or capacitive touch sensors 29, 31, 41, and/or IR sensors 33 can be used in the spout 12, manual valve handle(s) 17, and sink basin 16. The controller 26 may shift between various modes of operation depending upon outputs from the sensors 29, 31, 41, 33.

In another embodiment, the capacitive sensor(s) 41 may be used to detect a person approaching the sink basin 16 as illustrated at location 265 in FIG. 15 and discussed above. When the controller 26 senses a user approaching the sink basin 16 due to changes in capacitance detected by the capacitance sensor(s) 41, controller 26 turns on the power to an IR sensor 33 located on or adjacent spout 12. Controller 26 may also supply power to indicator lights, night lights, etc. (not shown) located on or adjacent sink basin 16 when a user approaches the sink basin 16. By powering up the IR sensor 33, as well as indicator lights, night lights, etc., when a user approaches the sink basin 16, the present invention reduces the amount of power used by the IR sensor 33, indicator lights, and night lights. Therefore, the IR sensor 33, indicator lights, and night lights may be powered by a battery. Once the user exits the region adjacent the sink basin 16 as sensed by the capacitive sensor(s) 41, the controller 26 may return the IR sensor 33, indicator lights, night lights, etc. to a low power mode to conserve battery life.

Capacitive sensor(s) 41 in the sink basin 16 may be used to control the temperature of water dispensed. In one embodiment, temperature is adjusted by sensing the user's hands moving in a predetermined manner within the basin 16 using capacitive sensor(s) 41. In another embodiment, the multiple capacitive sensors 41 at various locations in the sink basin 16 may be used to switch between different water temperatures. For example, depending upon the location of the user's hands in the sink basin 16, the temperature may be adjusted to a cold temperature for rinsing, a warmer temperature for washing hands, and a hot temperature for washing dishes or other items. The different capacitive sensors 41 at different locations can also be used to dispense different quantities of water automatically such as to fill a glass, fill a pan, or fill the entire sink basin 16. Indicia (pictures or icons representing different modes or functions) may be provided on the sink basin 16 or adjacent cabinets above the locations of capacitive sensor(s) 41 to show the user where to place the user's hands to start a particular mode or perform a particular function.

Capacitive sensor(s) 41 in the sink basin 16 may also be used in combination with the capacitive sensor(s) 29 in spout 12 to provide three dimensional mapping of the position of the user's hands adjacent to sink basin 16. For instance, one capacitive sensor 41 may be placed at the bottom of the sink basin 16 for use in combination with a capacitive sensor 29 on spout 12 to provide sensing of a vertical position of the user's hands within the basin 16. This vertical position can be used with the other sensing techniques discussed above which detect positions of the user's hands in a horizontal plane to provide the three dimensional mapping of the locations of the user's hands.

In another embodiment of the present invention, the capacitive sensors 29, 31, 41 and controller 26 may be used to control an electronic proportioning valve which controls water flow to the spout 12. In this embodiment, a flow rate of water may be adjusted depending upon the location of the user's hands within the sink basin 16. For instance, the water flow can be started at a first flow rate when the user's hands are detected in the sink basin 16. Controller 26 can adjust the electronic proportioning valve to increase the flow rate of the water once the user's hands are detected in the water stream 44 by capacitive sensors 41 and/or 29. Once the user's hands are removed from the water stream 44 but are still detected in the basin 16 by capacitive sensors 41 and/or 29, water flow is again restricted to the lower flow rate by controller 26. If the user's hands are not detected near basin 16, controller 26 shuts off the water supply using the electronic proportioning valve.

For medical or other applications, capacitive sensors 41 adjacent sink basin 16 can be used to detect the presence of a user in the room or adjacent the sink basin 16 as shown in FIG. 15. Controller 26 may start water flow upon detecting the user in the room. The flow rate of water can be adjusted depending upon whether or not the user's hands are in the water stream as discussed above. Controller 26 can automatically shut off the water flow through spout 12 when the user walks away from the sink basin 16 as detected by capacitive sensors 41 within the cabinet or other structure adjacent sink basin 16.

In other another embodiment, touch controls on the handles 17 such as capacitive sensors 31 may be used to override the hands free activation mode as determined by basin capacitive sensors 41. Grasping or touching the handles 17 as detected, for example, by capacitive sensors 31 may override the hands free activation detected by capacitive sensors 41 for manual operation of the valve 23 using handle(s) 17 as discussed above.

Although the invention has been described in detail with reference to certain preferred embodiments, variations and modifications exist within the spirit and scope of the invention as described and defined in the following claims.

The invention claimed is:

1. A fluid delivery apparatus comprising:

a spout formed from a non-conductive material;

a fluid supply conduit formed separately from the spout, the fluid supply conduit extending through the non-conductive material of the spout to provide a fluid flow path through the spout, and the fluid supply conduit also being formed from a non-conductive material;

a capacitive sensor embedded in and enclosed within the non-conductive material of the spout, the capacitive sensor generating a capacitive sensing field; and a controller coupled to the capacitive sensor to detect a user's presence in the capacitive sensing field.

2. The apparatus of claim 1, wherein the capacitive sensor includes a first sensor probe embedded in and enclosed within the non-conductive material of the spout and a second sensor probe spaced apart from the first sensor probe to define the capacitive sensing field therebetween.

3. The apparatus of claim 2, wherein the first sensor probe is coupled to the controller by a first electrical connector and the second sensor probe is coupled to the controller by a second electrical connector.

4. The apparatus of claim 2, wherein the second sensor probe is coupled to a sink basin which supports the spout.

5. The apparatus of claim 1, wherein the capacitive sensor detects a change in a dielectric constant within the capacitive sensing field adjacent the capacitive sensor.

6. The apparatus of claim 1, wherein the controller adjusts fluid flow through the fluid supply conduit based on capacitance changes detected by the capacitive sensor.

7. The apparatus of claim 1, further comprising a metal plate coupled to the non-conductive spout adjacent the capacitive sensor, the metal plate being coupled to the controller to provide a shield for the capacitive sensor.

8. The apparatus of claim 7, wherein the metal plate directs the capacitive sensing field of the capacitive sensor in a direction away from the metal plate.

9. The apparatus of claim 7, wherein the metal plate is located between the capacitive sensor and the fluid supply conduit.

10. The apparatus of claim 7, wherein the metal plate and the capacitive sensor are both embedded in the non-conductive material of the spout.

11. The apparatus of claim 1, further comprising a touch sensor coupled to the spout.

12. The apparatus of claim 11, wherein the touch sensor is coupled to the controller, the controller being configured to actuate a manually controlled fluid valve in response to detecting a user touching the touch sensor.

13. The apparatus of claim 1, wherein the non-conductive material is one of a cross-linked polyethylene (PEX), a cross-linked polyamide, a thermoset, a thermoplastic material.

14. The apparatus of claim 1, wherein the spout also includes portions made of metal.

15. A fluid delivery apparatus configured to deliver fluid into a sink basin, the apparatus comprising:

a spout located adjacent the sink basin, the spout being formed from a non-conductive material;

a fluid supply conduit formed separately from and supported by the spout, the fluid supply conduit extending through the non-conductive material of the spout to provide a fluid flow path through the spout, and the fluid supply conduit also being formed from a non-conductive material;

a capacitive sensor system including a first sensor probe embedded in and enclosed within the non-conductive material of the spout and a second sensor probe coupled to the sink basin to define a sensing field between the first and second sensor probes, the capacitive sensor system being configured to detect changes in a dielectric constant within the sensing field; and a controller coupled to the capacitive sensor system and configured to control the amount of fluid supplied to the fluid supply conduit based on an output from the capacitive sensor system.

16. The apparatus of claim 15, wherein the non-conductive material is one of a cross-linked polyethylene (PEX), a cross-linked polyamide, a thermoset, a thermoplastic material.

17. The apparatus of claim 15, further comprising a metal plate coupled to the spout adjacent the first sensor probe, the metal plate being coupled to the controller to provide a shield for the capacitive sensor system.

18. The apparatus of claim 17, wherein the metal plate is located between the first sensor probe and the fluid supply conduit.

19. The apparatus of claim 15, further comprising a touch sensor coupled to the spout.

20. The apparatus of claim 19, wherein the touch sensor is coupled to the controller, the controller being configured to actuate a manually controlled fluid valve in response to detecting a user touching the touch sensor.

21. A fluid delivery apparatus comprising:

a spout formed from a non-conductive material;

a fluid supply conduit formed separately from the spout, the fluid supply conduit extending through the non-conductive material of the spout to provide a fluid flow path through the spout, and the fluid supply conduit also being formed from a non-conductive material;

first, second, and third capacitive sensors embedded in and enclosed within the non-conductive material of the spout at different locations on the spout; and a controller coupled to the first, second and third capacitive sensors, the first capacitive sensor generating a capacitive sensing field to provide a proximity detector adjacent the spout, the controller providing a hands-free supply of fluid through the fluid supply conduit in response to detecting a user's presence in the capacitive sensing field of the first capacitive sensor, the controller being configured to increase the temperature of the fluid supplied to the fluid supply conduit in response to detecting a user's presence adjacent the second capacitive sensor, and the controller being configured to decrease the temperature of the fluid supplied to the fluid supply conduit in response to detecting a user's presence adjacent the third capacitive sensor.

22. The apparatus of claim 21, further comprising a fourth capacitive sensor coupled to the spout, the fourth capacitive sensor also being coupled to the controller, the controller being configured to switch the control of fluid delivery from the hands-free proximity sensing mode to a manual control mode in response to detecting a user's presence adjacent the fourth capacitive sensor.

23. The apparatus of claim 22, wherein the first, second, third, and fourth sensors are selectively coupled to the controller by switches so that the controller alternatively monitors the outputs from the first, second, third and fourth sensors.

24. The apparatus of claim 22, wherein the controller simultaneously monitors the first, second, third, and fourth sensors.

25. The apparatus of claim 24, wherein the first, second, third, and fourth sensors are coupled to the controller through capacitors having different capacitance values so that the controller can distinguish the outputs from the first, second, third, and fourth sensors.

26. The apparatus of claim 24, wherein the first, second, third, and fourth sensors are coupled to the controller through resistors having different resistance values so that the controller can distinguish the outputs from the first, second, third, and fourth sensors.

27. A fluid delivery apparatus configured to deliver fluid into a sink basin, the apparatus comprising:

a spout located adjacent the sink basin, the spout being formed in the non-conductive material;

a fluid supply conduit supported by the spout;

an IR sensor located adjacent the spout, the IR sensor being configured to detect the presence of a user's hands in the sink basin;

a capacitive sensor embedded in and enclosed within the non-conductive material of the spout, the capacitive sensor generating a capacitance sensing field; and a controller coupled to the IR sensor and the capacitive sensor and configured to control the amount of fluid supplied to the fluid supply conduit based on outputs from the IR sensor and the capacitive sensor, the controller being programmed to detect the presence of a user in the capacitance sensing field based on an output signal from the capacitance sensor.

28. The apparatus of claim 27, wherein the controller causes fluid flow through the fluid supply conduit upon detection of the user's hands in the sink basin by the capacitive sensor, regardless of whether the IR sensor detects the user's hands in the sink basin to reduce pulsing on and off of fluid flow.

29. The apparatus of claim 27, wherein the controller is programmed to detect a user approaching the sink basin by monitoring changes in capacitance detected within the capacitance sensing field, the controller being programmed to turns on power to the IR sensor upon detecting the user approaching the sink basin, thereby reducing the amount of power used by the IR sensor.

30. The apparatus of claim 29, wherein the controller also supplies power to a light located adjacent the sink basin upon detecting the user approaching the sink basin.

31. The apparatus of claim 29, wherein the IR sensor is powered by a battery.

32. The apparatus of claim 31, wherein the controller returns the IR sensor to a low power mode to conserve battery life when the controller detects that the user has moved away from the sink basin.

33. The apparatus of claim 1, wherein the spout is molded from a non-conductive polymeric material.

34. The apparatus of claim 27, wherein the spout and the fluid supply conduit are each formed from a non-conductive material, the fluid supply conduit being separate from and supported by the spout, the fluid supply conduit extending through the non-conductive material of the spout to provide a fluid flow path through the spout.

35. A fluid delivery apparatus comprising:

a spout;

a capacitive proximity sensor configured to define a capacitance sensing field in an area near the spout to detect a presence of a user;

a controller coupled to the capacitive sensor; and an IR sensor located adjacent the spout, the IR sensor being configured to detect the presence of a user's hands adjacent the spout, and wherein the controller is programmed to detect the presence of a user in the capacitance sensing field based on an output signal from the capacitance sensor, the controller also being programmed to turns on power to the IR sensor upon detecting presence of the user in the capacitance sensing field, thereby reducing the amount of power used by the IR sensor.

36. The apparatus of claim 35, wherein the controller causes fluid flow through the spout upon detection of the user in the capacitance sensing field.

37. The apparatus of claim 35, wherein the IR sensor is powered by a battery.

38. The apparatus of claim 35, wherein the controller returns the IR sensor to a low power mode to conserve battery life when the controller detects that the user has moved out of the capacitance sensing field.

* * * * *